US006787049B2

(12) United States Patent
Tom et al.

(10) Patent No.: US 6,787,049 B2
(45) Date of Patent: Sep. 7, 2004

(54) FLUID EJECTION DEVICE

(75) Inventors: Dennis W. Tom, Corvallis, OR (US); Juan J. Hernandez, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 270 days.

(21) Appl. No.: 09/967,138

(22) Filed: Sep. 28, 2001

(65) Prior Publication Data

US 2002/0021334 A1 Feb. 21, 2002

Related U.S. Application Data

(62) Division of application No. 09/262,872, filed on Mar. 2, 1999, now Pat. No. 6,347,861.

(51) Int. Cl.[7] ..... B41J 2/16

(52) U.S. Cl. ..... 216/27; 216/2; 216/11

(58) Field of Search ..... 216/2, 11, 27; 29/890.1; 347/20, 63, 64, 67; 257/753, 759, 792

(56) References Cited

U.S. PATENT DOCUMENTS

| | | | | |
|---|---|---|---|---|
| 4,438,191 | A | 3/1984 | Cloutier et al. | 430/324 |
| 4,660,058 | A | 4/1987 | Cordery | 347/48 |
| 5,975,686 | A | 11/1999 | Hauck et al. | 347/85 |
| 6,158,853 | A | 12/2000 | Olsen et al. | 347/86 |
| 6,406,636 | B1 | 6/2002 | Vaganov | 216/2 |
| 6,506,312 | B1 | 1/2003 | Bottomfield | 216/11 |
| 6,620,332 | B2 | 9/2003 | Amrich | 216/11 |

*Primary Examiner*—Anita Alanko

(57) ABSTRACT

A method of coupling a barrier layer to a substrate of a fluid ejection device includes disposing a mechanical intercoupling structure on a substrate at least one fluid ejector thereon; disposing a chamber layer over said substrate, wherein side walls of an ejection chamber are defined by the chamber layer; and substantially embedding said mechanical intercoupling structure with the chamber layer.

31 Claims, 7 Drawing Sheets

FLUID EJECTION DEVICE

CROSS REFERENCE TO REALTED APPLICATION(S)

This is a divisional of application Ser. No. 09/262,872 filed on Mar. 2, 1999, now U.S. Pat. No. 6,347,861 which is hereby incorporated by reference herein.

FIELD OF THE INVENTION

The present invention generally relates to printing technology, and more particularly to coupling a barrier layer to a substrate of a fluid ejection device.

BACKGROUND OF THE INVENTION

Substantial developments have been made in the field of electronic printing technology. A wide variety of highly-efficient printing systems currently exist which are capable of dispensing ink in a rapid and accurate manner, including thermal inkjet systems. The ink delivery systems described herein (and other printing units using different ink ejection devices) typically include an ink containment unit (e.g. a housing, vessel, or tank) having a self-contained supply of ink therein in order to form an ink cartridge. In a standard ink cartridge, the ink containment unit is coupling with the remaining components of the cartridge to produce an integral and unitary structure wherein the ink supply is considered to be "on-board."

Printing units using thermal inkjet technology basically involve an apparatus which includes at least one ink reservoir chamber in fluid communication with a substrate (preferably made of silicon and/or other comparable materials) having a plurality of thin-film heating resistors thereon. The substrate and resistors are maintained within a structure that is characterized as a "printhead." Selective activation of the resistors causes thermal excitation of the ink materials stored inside the reservoir chamber and expulsion thereof from the printhead. Representative thermal inkjet systems are discussed in U.S. Pat. Nos. 4,500,895 to Buck et al.; 4,794,409 to Cowger et al.; 4,509,062 to Low et al.; 4,929,969 to Morris; 4,771,295 to Baker et al.; 5,278,584 to Keefe et al.; and the *Hewlett-Packard Journal*, Vol. 39, No. 4 (August 1988), all of which are incorporated herein by reference.

A typical printhead will have at least one or more ink ejectors (e.g. thin-film resistor elements in a thermal inkjet system) on a substrate. The ink ejectors are each positioned within a compartment defined as a "firing chamber". Ink materials are then delivered to the firing chambers and thereafter expelled on-demand by the ink ejectors. Between and around the firing chambers on the substrate are numerous conductive circuit elements which electrically communicate with the ink ejectors and other components on the substrate. The circuit elements also communicate with the operating components of the printer unit that generate the electrical signals.

Positioned directly over the circuit elements and exposed portions of the underlying substrate is a composition defined as an "ink barrier material" or "ink barrier layer" or "chamber layer". The ink barrier material functions as an electrical insulator and "sealant" which covers these components and prevents them from coming in contact with the ink compositions being delivered. Likewise, the ink barrier material protects the circuit elements from physical impact, contaminants, and the like. As a result, electrical shorts, breaks, and similar problems are avoided which improves the overall reliability and longevity of the printing system under consideration.

Many different chemical compositions may be used to fabricate the ink barrier layer, with organic compositions (e.g. polymers and other related materials), including those with a high dielectric constant. After placement of the ink barrier material (preferably in a discrete layer) on the underlying substrate and thin-film circuitry, an orifice plate with multiple ink ejection openings therethrough is positioned on the barrier layer and over the firing chambers which contain the ink ejectors. The orifice plate is then adhesively or otherwise affixed in position.

A factor in printhead design involves the overall structural integrity of the entire printhead unit. The term "structural integrity" as used herein generally concerns the ability of the individual components in the printhead to remain affixed together in a strong and cohesive manner without the detachment or delamination of any elements. It is desired that ink "barrier" materials within the printhead are securely attached to the underlying thin film circuitry and substrate associated therewith.

Notwithstanding the beneficial features discussed above, problems may arise in printhead systems if the barrier layer "delaminates" or otherwise detaches in a complete or partial manner from the underlying substrate and circuitry thereon. These problems typically cause (1) ink "shorts" in which ink from the firing chambers and adjacent regions in the printhead "wicks" into any gaps formed between the thin-film circuitry and the barrier layer; (2) undesired changes in firing chamber architecture caused by barrier delamination around the chambers; and/or (3) the propagation of additional cracks, fissures, gaps, stress lines, and the like once the initial delamination of the barrier layer occurs. All of these undesired situations can lead to improper ink drop ejection, decreased longevity, reduced reliability, and an overall deterioration in print quality. Accordingly, gap-free adhesion of the substrate (and circuitry thereon) to the ink barrier layer is desired.

The chemical interactions which adhere these components to each other within the printhead are not well understood from a molecular standpoint. However, it is currently believed that the chemical bond between the organic ink barrier layer and the substrate having the electrical circuitry thereon is one of the weakest and most potentially troublesome in the entire printhead structure. In attempting to solve this problem, the following diverse approaches have been considered: (1) elaborate cleaning and "decontamination" of the substrate, thin-film electrical circuitry, and surrounding components; (2) chemical modification of the barrier layer, substrate, and/or electrical circuit elements; and/or (3) the use of additional (e.g. supplemental) chemical adhesive materials. However, it is not currently believed that any of these approaches provide sufficient results from a cost, efficiency, and structural design standpoint. Thus, there is a desire for an effective solution to the foregoing problem in which a high degree of structural integrity is maintained between the ink barrier layer and substrate/thin-film circuitry in an inkjet or other ink delivery printhead.

Therefore, it is desirable to (1) prevent delamination problems between the ink barrier layer and underlying thin-film structures in a wide variety of different thermal inkjet and non-thermal-inkjet printheads; (2) avoid electrical shorts and undesired changes in printhead architecture which may occur when barrier layer delamination takes place; (3) improve adhesion between the ink barrier layer and the circuit-containing substrate without using supplemental adhesives and elaborate decontamination procedures; (4) avoid crack propagation throughout the printhead which can result from ink barrier layer delamination; and (5) accomplish these goals in an economical manner which is especially well-suited for use on a mass production scale.

SUMMARY

One embodiment of a method of coupling a barrier layer to a substrate of a fluid ejection device includes disposing a mechanical intercoupling structure on a substrate at least one fluid ejector thereon; disposing a chamber layer over said substrate, wherein side walls of an ejection chamber are defined by the chamber layer; and substantially embedding said mechanical intercoupling structure with the chamber layer.

These and other benefits, objects, features, and advantages will now be discussed in the following Brief Description of the Drawings and Detailed Description of Preferred Embodiments.

BRIEF DESCRIPTION OF THE DRAWINGS

The drawing figures provided below are schematic and representative only. They shall not limit the scope of the invention in any respect. Likewise, reference numbers that are carried over from one figure to another shall constitute common subject matter in the figures under consideration.

DETAILED DESCRIPTION

Figure 1:
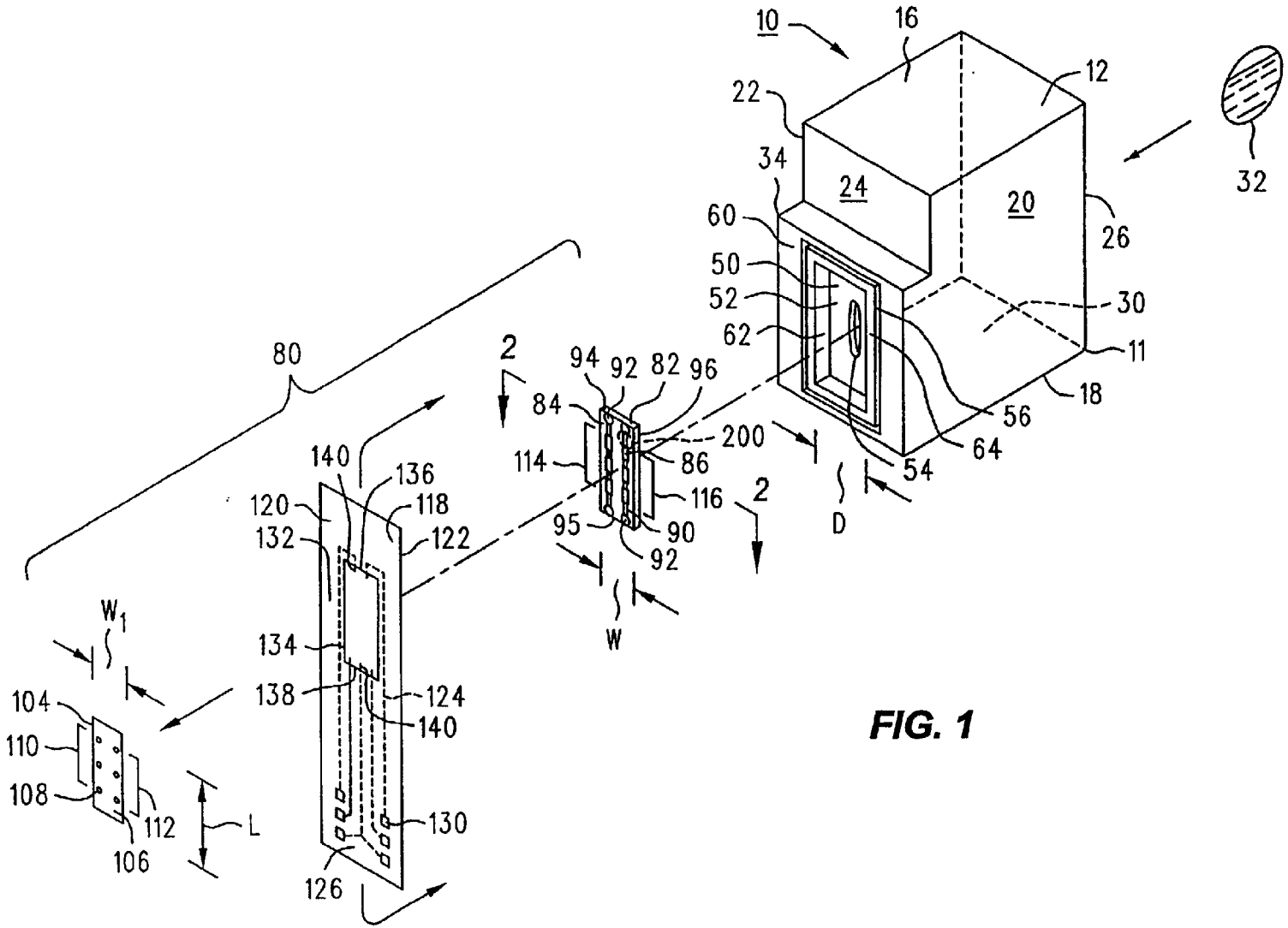
FIG. 1 is a schematically-illustrated, exploded perspective view of a representative fluid delivery system in the form of a cartridge which is suitable for use with the components and methods of an embodiment of the present invention.

In accordance with an embodiment of the present invention, a high-durability printhead structure for an ink delivery system is disclosed. The printhead of an embodiment of the present invention is characterized by a number of features including but not limited to secure engagement of the ink barrier layer (or chamber layer) to the underlying substrate and thin-film circuitry thereon. As a result, ink-induced shorts, delamination of the printhead structure, crack propagation, reduced longevity, and other comparable problems are avoided as discussed later in this section. The term "ink delivery system" as used herein shall again be broadly construed to include, without restriction, any type of printhead structure having at least one ink ejector associated therewith (discussed below) which is in fluid communication either directly or remotely with a supply of ink. In this regard, an embodiment of the invention shall not be considered "printhead specific" and is prospectively applicable to a number of different designs, technologies, and component arrangements.

While an embodiment of the present invention shall be described below with primary reference to thermal inkjet technology, many different ink delivery systems can be employed with equivalent results provided that the selected systems again include a printhead having at least one ink ejector associated therewith. The term "ink ejector" shall involve any component, device, element, or structure which may be used to expel ink on-demand from the printhead. For example, in a thermal inkjet printing system, the phrase "ink ejector" will encompass the use of one or more selectively-energizable thin-film heating resistors as outlined in greater detail below. To provide a clear and complete understanding of embodiments of the invention, the following detailed description will be divided into two sections, namely, (1) "A. General Overview of Thermal Inkjet Technology"; and (2) "B. Embodiments of the Printhead of the Present Invention".

A. General Overview of Thermal Inkjet Technology

An embodiment of the present invention is again applicable to a wide variety of ink delivery systems which include (1) a printhead; (2) at least one "ink ejector" associated with the printhead; and (3) an ink containment vessel having a supply ink therein as previously noted which is operatively connected to and in fluid communication with the printhead. The ink containment vessel may be directly attached to the printhead or remotely connected thereto in an "off-axis" system as previously discussed using one or more ink transfer conduits. The phrase "operatively connected" as it applies to the printhead and ink containment vessel shall encompass both of these variants and equivalent structures. As previously stated, the term "ink ejector" is defined to involve any component, system, or device which selectively ejects or expels ink on-demand from the printhead. Thermal inkjet cartridges which use multiple heating resistors as ink ejectors are preferred for this purpose. However, the invention shall not be restricted to any particular ink ejectors or ink printing technologies. A wide variety of different ink delivery devices may be encompassed within an embodiment of the invention including but not limited to piezoelectric drop systems of the general type disclosed in U.S. Pat. No. 4,329,698 to Smith and dot matrix devices of the variety described in U.S. Pat. No. 4,749,291 to Kobayashi et al., as well as other comparable and functionally equivalent systems designed to deliver ink using one or more ink ejector devices. The specific operating components associated with these alternative systems (e.g. the piezoelectric elements in the system of U.S. Pat. No. 4,329,698) shall be encompassed within the term "ink ejectors" as previously defined. The term "ink ejector" or "fluid ejector" shall encompass any device, component, or element which may be used to deliver ink on-demand from the printhead under consideration.

To facilitate a complete understanding of the components and methods as they apply to thermal inkjet technology (which is the preferred system of primary interest), an overview of thermal inkjet technology will now be provided. A representative ink delivery system in the form of a thermal inkjet cartridge unit is illustrated in FIG. 1 at reference number 10. It shall be understood that cartridge 10 is presented herein for example purposes and is non-limiting. Cartridge 10 is shown in schematic format in FIG. 1, with more detailed information regarding cartridge 10 and its various features (as well as similar systems) being provided in U.S. Pat. Nos. 4,500,895 to Buck et al.; 4,794,409 to Cowger et al.; 4,509,062 to Low et al.; 4,929,969 to Morris; 4,771,295 to Baker et al.; 5,278,584 to Keefe et al.; and the *Hewlett-Packard Journal*, Vol. 39, No. 4 (August 1988), all of which are incorporated herein by reference.

With continued reference to FIG. 1, the cartridge 10 first includes an ink containment vessel 11 in the form of a housing 12. As noted above, the housing 12 shall constitute the ink containment unit of an embodiment of the invention, with the terms "ink containment unit", "housing", "vessel", and "tank" all being considered equivalent from a functional and structural standpoint. The housing 12 further comprises a top wall 16, a bottom wall 18, a first side panel 20, and a second side panel 22. In the embodiment of FIG. 1, the top wall 16 and the bottom wall 18 are substantially parallel to each other. Likewise, the first side panel 20 and the second side panel 22 are also substantially parallel to each other.

The housing 12 additionally includes a front wall 24 and a rear wall 26 which is optimally parallel to the front wall 24 as illustrated. Surrounded by the front wall 24, rear wall 26, top wall 16, bottom wall 18, first side panel 20, and second side panel 22 is an interior chamber or compartment 30 within the housing 12 (shown in phantom lines in FIG. 1) which is designed to retain a supply of an ink composition 32 therein that is either in unconstrained (e.g. "free-flowing") form or retained within a multicellular foam-type structure.

The front wall 24 also includes an externally-positioned, outwardly-extending printhead support structure 34 which comprises a substantially rectangular central cavity 50. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54. Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64.

With continued reference to FIG. 1, fixedly secured to the housing 12 of the ink cartridge 10 (e.g. attached to the outwardly-extending printhead support structure 34) is a printhead generally designated in FIG. 1 at reference number 80. While the specific structural details of the printhead assembly of an embodiment of the present invention will be discussed in the next section, a brief overview of the printhead 80 shown in FIG. 1 will now be provided for background information purposes. The printhead 80 comprises two main components fixedly secured together (with certain sub-components positioned therebetween which are also of considerable importance). The first main component used to produce the printhead 80 is a substrate. In one embodiment, the substrate is manufactured from silicon. In another embodiment, the substrate is manufactured from silicon carbide (SiC) on silicon nitride (SiN) or a number of other materials known in the art for this purpose. Using standard thin film fabrication techniques, a plurality of individually-energizable thin-film resistors 86 which function as "ink ejectors" are disposed upon an upper surface 84 of the printhead substrate. The resistors 86 are preferably fabricated from a tantalum-aluminum composition known in the art for resistor construction. Only a small number of resistors 86 are shown in the schematic representation of FIG. 1, with the resistors 86 being presented in enlarged format for the sake of clarity. Also provided on the upper surface 84 of the substrate using photolithographic thin-film techniques is a plurality of metallic conductive traces 90 (also designated herein as "bus members", "elongate conductive circuit elements", or simply "circuit elements") which electrically communicate with the resistors 86. The circuit elements 90 likewise communicate with multiple metallic pad-like contact regions 92 positioned at the ends 94, 95 of the substrate on the upper surface 84. The function of all these components which, in combination, are collectively designated herein as a "resistor assembly" 96 will be summarized further below. Likewise, the circuit elements 90, the role that they play, and other information involving the protection of these components will be presented in subsequent portions of this discussion. However, it should be noted that only a small number of circuit elements 90 are illustrated in the schematic representation of FIG. 1 which are again presented in enlarged format for the sake of clarity.

Many different materials and design configurations may be used to construct the resistor assembly 96, with an embodiment of the present invention not being restricted to any particular elements, materials, and structures for this purpose unless otherwise indicated. However, in a preferred, representative, and non-limiting embodiment, the resistor assembly 96 will be approximately 0.5 inches long, and will likewise contain about 300 resistors 86 thus enabling a resolution of 600 dots per inch ("DPI"). The upper surface 84 of the printhead substrate having the resistors 86 thereon will preferably have a width "W" (FIG. 1) which is less than the distance "D" between the side walls 62, 64 of the mounting frame 56. As a result, ink flow passageways are formed on both sides of the substrate so that ink flowing from the ink outlet port 54 in the central cavity 50 can ultimately come in contact with the resistors 86. It should also be noted that the substrate may include a number of other components thereon (not shown) depending on the type of ink cartridge 10 under consideration. For example, the substrate may likewise comprise a plurality of logic transistors for precisely controlling operation of the resistors 86, as well as a "demultiplexer" as discussed in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity of the circuitry (e.g. contact regions 92 and circuit elements 90) formed on the upper surface 84 of the substrate. For the purposes of an embodiment of this invention, any demultiplexer circuitry, logic transistors, and the like shall also be encompassed within the term "circuit elements" used herein.

Securely affixed to the upper surface 84 of the substrate (with a number of intervening material layers therebetween including an ink barrier layer as discussed in considerable detail below) is the second main component of the printhead 80. Specifically, an orifice plate 104 is provided as shown in FIG. 1 which is used to distribute the selected ink compositions to a designated print media material (e.g. paper). In general, the orifice plate 104 has a panel member 106 (illustrated schematically in FIG. 1) which is manufactured from one or more metal compositions (e.g. gold-plated nickel [Ni] and the like). In a typical and non-limiting representative embodiment, the orifice plate 104 will have a length "L" of about 5–30 mm and a width "$W_1$" of about 3–15 mm. However, the invention shall not be restricted to any particular orifice plate parameters unless otherwise indicated herein.

The orifice plate 104 further comprises at least one and preferably a plurality of openings or "orifices" therethrough which are designated at reference number 108. These orifices 108 are shown in enlarged format in FIG. 1. Each orifice 108 in a representative embodiment will have a diameter of about 0.01–0.05 mm. In the completed printhead 80, all of the components listed above are assembled so that each of the orifices 108 is aligned with at least one of the resistors 86 (e.g. "ink ejectors") on the substrate upper surface 84. As result, energization of a given resistor 86 will cause ink expulsion from the desired orifice 108 through the orifice plate 104. The invention shall not be limited to any particular size, shape, or dimensional characteristics in connection with the orifice plate 104 and shall likewise not be restricted to any number or arrangement of orifices 108. In an exemplary embodiment as presented in FIG. 1, the orifices 108 are arranged in two rows 110, 112 on the panel member 106 associated with the orifice plate 104. If this arrangement of orifices 108 is employed, the resistors 86 on the resistor assembly 96 (e.g. the substrate) will also be arranged in two corresponding rows 114, 116 so that the rows 114, 116 of resistors 86 are in substantial registry with the rows 110, 112 of orifices 108. Further general information concerning this type of metallic orifice plate system is provided in, for example, U.S. Pat. No. 4,500,895 to Buck et al. which is incorporated herein by reference.

It should also be noted for background purposes that, in addition to the systems which involve metal orifice plates, alternative printing units have effectively employed orifice plate structures constructed from non-metallic organic polymer compositions. These structures typically have a representative and non-limiting thickness of about 1.0–2.0 mils. In this context, the term "non-metallic" will encompass a product which does not contain any elemental metals, metal alloys, or metal amalgams. The phrase "organic polymer" involves a long-chain carbon-containing structure of repeating chemical subunits. A number of different polymeric compositions may be employed for this purpose. For example, non-metallic orifice plate members can be manufactured from the following compositions: polytetrafluoroethylene (e.g. Teflon®), polyimide, polymethylmethacrylate, polycarbonate, polyester, polyamide, polyethylene terephthalate, or mixtures thereof. Likewise, a representative commercial organic polymer (e.g. polyimide-based) composition which is suitable for constructing a non-metallic organic polymer-based orifice plate member in a thermal inkjet printing system is a product sold under the trademark "KAPTON" by E. I. du Pont de Nemours & Company of Wilmington, Del. (USA). Further data regarding the use of non-metallic organic polymer orifice plate systems is provided in U.S. Pat. No. 5,278,584 (incorporated herein by reference).

With continued reference to FIG. 1, a film-type flexible circuit member 118 is likewise provided in connection with the cartridge 10 which is designed to "wrap around" the outwardly-extending printhead support structure 34 in the completed ink cartridge 10. Many different materials may be used to produce the circuit member 118, with non-limiting examples including polytetrafluoroethylene (e.g. Teflon®), polyimide, polymethylmethacrylate, polycarbonate, polyester, polyamide, polyethylene terephthalate, or mixtures thereof. Likewise, a representative commercial organic polymer (e.g. polyimide-based) composition which is suitable for constructing the flexible circuit member 118 is a product sold under the trademark "KAPTON" by E. I. du Pont de Nemours & Company of Wilmington, Del. (U.S.A.) as previously noted. The flexible circuit member 118 is secured to the printhead support structure 34 by adhesive affixation using adhesive materials (e.g. epoxy resin compositions known in the art for this purpose). The flexible circuit member 118 enables electrical signals to be delivered and transmitted from the printer unit (not shown) to the resistors 86 (or other ink ejectors) on the substrate upper surface 84 as discussed herein. The film-type flexible circuit member 118 further includes a top surface 120 and a bottom surface 122 (FIG. 1). Formed on the bottom surface 122 of the circuit member 118 and shown in dashed lines in FIG. 1 is a plurality of metallic (e.g. gold-plated copper) circuit traces 124 which are applied to the bottom surface 122 using known metal deposition and photolithographic techniques. Many different circuit trace patterns may be employed on the bottom surface 122 of the flexible circuit member 118, with the specific pattern depending on the particular type of ink cartridge 10 and printing system under consideration. Also provided at position 126 on the top surface 120 of the circuit member 118 is a plurality of metallic (e.g. gold-plated copper) contact pads 130. The contact pads 130 communicate with the underlying circuit traces 124 on the bottom surface 122 of the circuit member 118 via openings or "vias" (not shown) through the circuit member 118. During use of the ink cartridge 10 in a printer unit, the pads 130 come in contact with corresponding printer electrodes in order to transmit electrical control signals from the printer unit to the contact pads 130 and traces 124 on the circuit member 118 for ultimate delivery to the resistor assembly 96. Electrical communication between the resistor assembly 96 and the flexible circuit member 118 will again be outlined below.

Positioned within the middle region 132 of the film-type flexible circuit member 118 is a window 134 which is sized to receive the orifice plate 104 therein. As shown schematically in FIG. 1, the window 134 includes an upper longitudinal edge 136 and a lower longitudinal edge 138. Partially positioned within the window 134 at the upper and lower longitudinal edges 136, 138 are beam-type leads 140 which, in a representative embodiment, are gold-plated copper and constitute the terminal ends (e.g. the ends opposite the contact pads 130) of the circuit traces 124 positioned on the bottom surface 122 of the flexible circuit member 118. The leads 140 are designed for electrical connection by soldering, thermocompression bonding, and the like to the contact regions 92 on the upper surface 84 of the substrate associated with the resistor assembly 96. As a result, electrical communication is established from the contact pads 130 to the resistor assembly 96 via the circuit traces 124 on the flexible circuit member 118. Electrical signals from the printer unit (not shown) can then travel via the elongate conductive circuit elements 90 on the substrate upper surface 84 to the resistors 86 so that on-demand heating (energization) of the resistors 86 can occur.

It is desired to emphasize that an embodiment of the present invention shall not be restricted to the specific printhead 80 illustrated in FIG. 1 and discussed above (which is shown in abbreviated, schematic format), with many other printhead designs also being suitable for use in accordance with an embodiment of the invention. The printhead 80 of FIG. 1 is again provided for example purposes and shall not limit the invention in any respect. Likewise, it should also be noted that if a non-metallic organic polymer-type orifice plate system is desired, the orifice plate 104 and flexible circuit member 118 can be manufactured as a single unit as discussed in U.S. Pat. No. 5,278,584.

The last major step in producing the completed printhead 80 involves physical attachment of the orifice plate 104 in position on the underlying portions of the printhead 80 (including the ink barrier layer as discussed below) so that the orifices 108 are in precise alignment with the resistors 86 on the substrate upper surface 84. Attachment of these components together may likewise be accomplished through the use of adhesive materials (e.g. epoxy and/or cyanoacrylate adhesives known in the art for this purpose).

The ink cartridge 10 discussed above in connection with FIG. 1 involves a "self-contained" ink delivery system which includes an "on-board" supply of ink. An embodiment of the present invention may likewise be used with other systems (both thermal inkjet and non-thermal-inkjet) which employ a printhead and a supply of ink stored within an ink containment vessel that is remotely spaced but operatively connected to and in fluid communication with the printhead. Fluid communication is optimally accomplished using one or more tubular conduits. An example of such a system is again disclosed in co-owned pending U.S. patent application Ser. No. 08/869,446 (filed on Jun. 5, 1997) entitled "AN INK CONTAINMENT SYSTEM INCLUDING A PLURAL-WALLED BAG FORMED OF INNER AND OUTER FILM LAYERS" (Olsen et al.) and co-owned pending U.S. patent application Ser. No. 08/873,612 (filed Jun. 11, 1997) entitled "REGULATOR FOR A FREE-INK INKJET PEN" (Hauck et al.) which are all incorporated herein by reference. This type of "remote" system (which is basically known as an "off-axis" unit) involves a tank-like housing containing a supply of ink therein that is operatively connected to and in fluid communication with a printhead that includes at least one ink ejector as defined above. Representative ink ejectors comprise the resistor units employed in thermal inkjet systems and other devices (e.g. piezoelectric elements and the like). Accordingly, the main difference between an "off-axis" system and the apparatus FIG. 1 is the proximity and orientation of the ink containment vessel relative to the printhead, with both types of systems being entirely applicable to this case. In this regard, any discussion of particular printheads, ink delivery systems, and related data shall be considered representative only.

B. Embodiments of the Fluid Ejection Device of the Present Invention

As previously noted, an embodiment of the present invention involves a highly specialized system in which the internal components of the printhead are secured together in a manner which avoids problems associated with short circuits and premature component delamination. Of particular concern in an embodiment of this invention is the attachment of a structure defined as the "ink barrier layer" or "layer of ink barrier material" or chamber layer to the underlying printhead substrate and circuit elements thereon. While not specifically shown in the schematic drawing of FIG. 1, the ink barrier layer will be clearly described in this section and illustrated in the remaining drawing figures. The ink barrier layer in an inkjet printhead (or other comparable system) basically involves a layer of material which functions as an insulator and "sealant" composition. In a preferred embodiment designed to provide optimum results, the ink barrier layer is produced from at least one or more organic compounds (e.g. polymers/monomers), with specific examples being recited below. The ink barrier layer is designed to completely cover the conductive circuitry surrounding the ink ejectors in the printhead in order to prevent direct communication between the circuitry and ink materials in the system. Should ink compositions come in contact with the conductive circuit elements on the substrate, electrical shorting of the circuitry may occur which can cause numerous problems including but not limited to misfiring or nonfiring of the ink ejectors. In this regard, a function of the ink barrier layer is to provide a protective insulating "cover" on the delicate circuitry surrounding the ink ejectors in the printhead. In addition to the problems listed above, premature delamination of the ink barrier layer relative to the substrate and components thereon can adversely change the overall structural configuration of the ink ejector firing (or ejection) chambers in a thermal inkjet system. (An example of a firing chamber is shown in at reference numeral 72 of FIG. 8 in U.S. Pat. No. 5,278,584, incorporated by reference herein.) This problem can cause misdelivery of the ink materials and a general deterioration in print quality. Thus, proper, secure, and permanent attachment of the ink barrier layer to the substrate is of primary importance in the development of a strong and durable printhead (regardless of the particular ink ejection technology associated therewith).

As discussed in considerable detail below, the ink barrier layer within the printhead surrounds the individual ink ejectors and is located between the underlying substrate and overlying orifice plate. In printhead systems, the bond between the ink barrier layer and the printhead substrate having the thin-film circuitry thereon is one of the weakest in the entire printhead. An embodiment of present invention provides an attachment system between these components which is highly effective and avoids the use of separate (e.g. additional) adhesive materials, elaborate supplemental surface treatment processes, and the like. In one embodiment, these supplemental processes and materials are used in combination with an embodiment of the invention if desired. In another embodiment, these supplemental processes and materials are not used. Furthermore, while specific construction materials, processing parameters, size values, and the like will be presented below in connection with the system, this information shall be considered representative only and non-limiting unless otherwise stated.

The specialized attachment process and components associated therewith will now be discussed in detail. Where possible, reference numbers from the structure of FIG. 1 will be carried over into the other figures described below in order to identify elements which are common to all figures. With reference to FIG. 1 and the discussion provided in the previous section, the upper surface 84 of the printhead substrate again includes a plurality of conductive traces 90 thereon (also characterized herein as "bus members", "elongate conductive circuit elements", or simply "circuit elements") which electrically communicate with the resistors 86. While the schematically-illustrated representation of FIG. 1 includes a small number of circuit elements 90, the substrate upper surface 84 may actually contain a large number of elements 90 which are again photolithographically produced on the substrate upper surface 84 as outlined in greater detail below. In particular, a typical thermal inkjet printhead will include approximately 1–250 circuit elements 90 per $mm^2$ (or more, depending on the complexity of the printhead under consideration). However, an embodiment of the present invention as discussed in this section shall not be restricted to a printhead structure with any given number of elongate conductive circuit elements 90 thereon which will become readily apparent from the following discussion of the attachment system.

Figure 2:
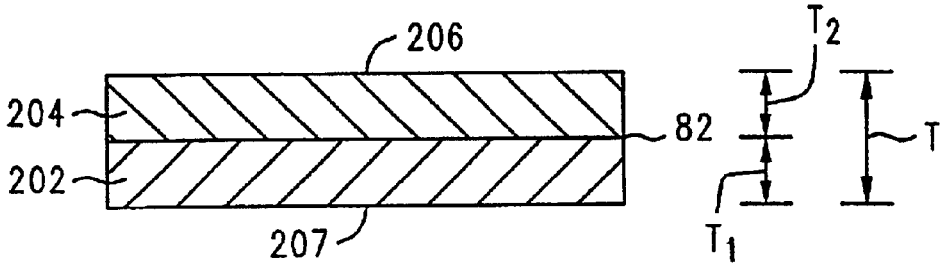
FIGS. 2–15 are cross-sectional schematic views which illustrate the steps, components, and procedures that are used to produce the high-durability printhead of an embodiment of the present invention in which the ink barrier layer is securely retained in position on the substrate using one or more anchoring structures. The views associated with FIGS. 2–15 involve the particular portion of the printhead taken along line 2—2 in FIG. 1 and encompassed within the circled region in said figure.

As illustrated in FIG. 1, the portion of the substrate that is of primary interest in an embodiment of the present invention is encompassed within the circled region 200. This circled region 200 and the process steps which are used to produce the structures thereon are shown in enlarged and expanded format in FIGS. 2–20 taken cross-sectionally along line 22. The enlarged structures of FIGS. 2–20 are especially designed to illustrate a number of very small components which are not visible in the exploded schematic view of FIG. 1. Beginning with FIG. 2, fabrication of the circled region 200 of the substrate associated with the printhead 80 (including the anchoring system of an embodiment of the present invention) will be illustrated in sequential format. The structures presented in these figures are greatly enlarged and not necessarily drawn to scale for the sake of clarity. In FIG. 2, the substrate is shown at the initial stages of production. For the sake of brevity and simplicity, in the embodiment described and shown in FIG. 2, the layers 202 and 204 are referred to as the substrate 82. However, in other embodiments, the layers 202 and 204 are disposed over the upper surface 84 of the printhead substrate.

A number of different construction materials may be employed without limitation in connection with the substrate 82. Various materials which may be used to manufacture the substrate 82 include the following representative compositions: silicon nitride (SiN) coated with a layer of silicon carbide (SiC), as well as silicon dioxide, aluminum oxide, and any other dielectric and/or ceramic compositions known in the art for substrate fabrication which have electrically insulating properties, such as silicon. This list (along with the other lists of construction materials provided below) is presented for example purposes only and shall not limit the invention in any respect.

In a preferred embodiment designed to provide optimum results, the substrate 82 will comprise a base layer 202 of silicon nitride (SiN) and top layer 204 of silicon carbide (SiC) thereon which may be applied on the base layer 202 using many different methods including spin coating and other deposition techniques.

With continued reference to FIG. 2, the substrate 82 (which may again involve a single layer of material or multiple layers 202, 204) includes an upper surface 206 and a lower surface 207. To provide optimum results and a maximum degree of structural integrity in the completed printhead 80, the upper surface 206 is preferably (e.g. optionally) pre-treated in order to clean and otherwise decontaminate it. In a representative and non-limiting embodiment, this step is accomplished by an argon plasma etch. However, it should be noted that the cleaning process discussed above represents a normal and customary procedure which is used in printhead fabrication. Additional cleaning/decontamination stages beyond those which are considered "normal" are not in an embodiment of the present invention, notwithstanding its ability to securely bond the ink barrier layer and substrate 82 together in a highly effective manner, although the present invention is not limited to as such. In fact, it is a benefit of the process that secure adhesion of the ink barrier layer to the substrate (and circuitry on the substrate upper surface 84) is accomplished without the use of additional adhesive materials, supplemental cleaning processes, and the like. The substrate 82 is then ready for further processing.

The substrate of FIG. 2 has a preferred thickness "T" of about 0.35–0.75 $\mu$m, with the base layer 202 made of silicon nitride having a representative thickness "$T_1$" of about 0.20–0.50 $\mu$m and the top layer 204 of silicon carbide having an exemplary thickness "$T_2$" of about 0.15–0.25 $\mu$m. These values are nonetheless subject to variation in accordance with preliminary pilot studies involving the particular type of printhead under consideration, the construction materials involved, and other factors.

Figure 3:
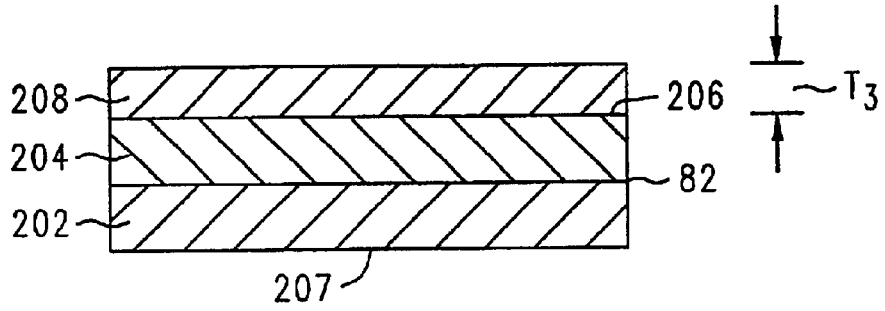

The next stage in the process is illustrated in FIG. 3. As shown in this figure (which again represents a preferred but non-limiting embodiment of the invention), a lower layer 208 of a first metal is deposited directly on the upper surface 206 of the substrate 82. Deposition of the lower layer 208 of the first metal may be accomplished in a number of different ways without restriction including but not limited to sputtering (planar and cylindrical), filament evaporation (using a tungsten-based or other comparable system), electron beam evaporation, flash evaporation, and/or induction evaporation and the like as discussed in, for example, Elliott, D. J., *Integrated Circuit Fabrication Technology*, McGraw-Hill Book Company, New York (1982)—(ISBN No. 0-07-019238-3), pp. 18–21 which is incorporated herein by reference. Placement of the lower layer 208 of the first metal on the substrate 82 shall not be limited to any particular regions on the substrate 82 unless otherwise stated herein. Thus, the lower layer 208 may be deposited at any location on the substrate 82 where anchor members (discussed below) are desired. However, from a general standpoint relative to the thermal inkjet printhead 80 of FIG. 1 and other comparable systems, it can be stated that the lower layer 208 is typically applied to all or part of those regions of the substrate 82 which surround the ink ejector(s), namely, the thin-film resistors 86.

While an embodiment of the invention described herein shall not be restricted to any particular thickness values in connection with the lower layer 208 of the first metal, optimal results are achieved when the lower layer 208 has an exemplary thickness "$T_3$" of about 0.3–1.0 $\mu$m. Regarding the specific materials used in connection with the first metal employed in the lower layer 208, a number of different compositions can be employed for this purpose provided that the selected first metal is able to provide resistance to chemical corrosion and mechanical protection of the structures thereunder. While elemental tantalum (Ta) is a preferred metal for use in the lower layer 208, a number of different metals can be employed for this purpose including but not limited to the following elemental metals: tantalum (Ta) as noted above, aluminum (Al), chromium (Cr), rhodium (Rh), titanium (Ti), molybdenum (Mo), and mixtures thereof. All of these metals are related by their common ability to offer the benefits listed above. It should also be understood that the phrase "a first metal" as used in connection with the lower layer 208 shall likewise encompass multiple metals in combination although a single elemental metal is preferred for this purpose with elemental tantalum again providing optimum results. The lower layer 208 of the first metal is likewise best delivered at a uniform thickness (see the representative range listed above) wherever it is applied.

Figure 4:
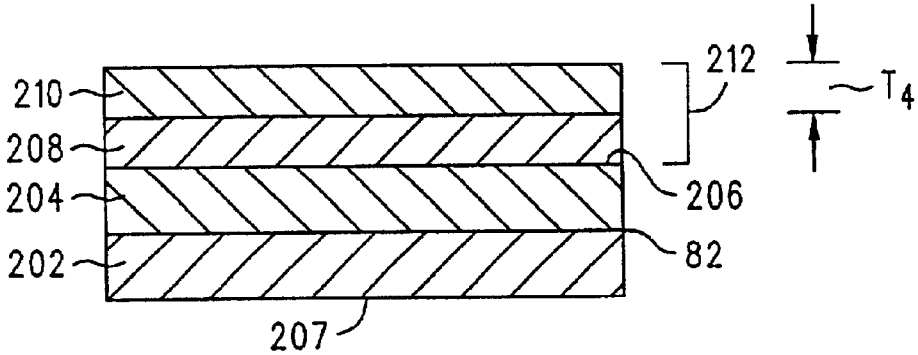

Referring now to FIG. 4, an upper layer 210 of a second metal is applied directly on top of the previously-deposited lower layer 208 of the first metal. Deposition of the upper layer 210 of the second metal may be accomplished in a number of different ways without restriction including but not limited to sputtering, (planar and cylindrical), filament evaporation (using a tungsten-based or other comparable system), electron beam evaporation, flash evaporation, and/or induction evaporation and the like as discussed in, for example, Elliot, D. J., *Integrated Circuit Fabrication Technology*, McGraw-Hill Book Company, New York (1982)—(ISBN No. 0-07-019238-3), pp. 18–21 which is again incorporated herein by reference. Placement of the upper layer 210 shall not be limited to any particular regions or zones on the lower layer 208 unless otherwise stated herein. However, the upper layer 210 of the second metal is optimally deposited on the entire lower layer 208 so that the lower layer 208 is completely covered with the upper layer 210. In this manner, a maximum level of production efficiency can be achieved with a minimal number of process steps.

With continued reference to FIG. 4, while the invention shall not be restricted to any particular thickness values in connection with the upper layer 210 of the second metal, optimal results will be achieved when the upper layer 210 has an exemplary thickness "$T_4$" of about 0.2–1.3 $\mu$m. Regarding the specific materials used in connection with the second metal employed in the upper layer 210, a number of different compositions can be employed for this purpose provided that the selected second metal is able to effectively conduct electricity and resist chemical corrosion. Likewise, it is preferred that the second metal used in the upper layer 210 be different from the first metal employed in the lower layer 208 as previously noted. While elemental gold (Au) provides optimum results as the second metal in the upper layer 210, a number of different metals can be employed for this purpose including but not limited to gold (Au) as noted above, aluminum (Al), rhodium (Rh), and mixtures thereof. All of these metals are related by their common ability to offer the benefits listed above. It should also be understood that the phrase "a second metal" as used in connection with the upper layer 210 shall likewise encompass multiple metals in combination although a single elemental metal is preferred for this purpose, with elemental gold again providing excellent results. The upper layer 210 of the second metal is likewise best delivered at a uniform thickness (see the representative range listed above) wherever it is applied. In one embodiment, the layer 210 forms at least part of the multiple metallic pad-like contact regions 92 positioned at the ends 94, 95 of the substrate upper surface 84, as shown in FIG. 1, and metal bus lines (bus members). For simplicity sake, upwardly extending structures 234 (described below) having the layer 210 are referred to herein as the elongate conductive circuit elements 90, which include the contact regions 92.

As a result of the foregoing process, a dual-layer metallic coating illustrated at reference number 212 in FIG. 4 is provided on the substrate which includes (1) the lower layer 208 of the first metal; and (2) the upper layer 210 of the second metal which is positioned on the lower layer 208. This dual-layer metallic coating 212 is thereafter processed as discussed below to produce a plurality of structures (such as upwardly extending members 234) including (A) circuit elements 90; and (B) at least one isotropically-etched anchor member which is used to secure the ink barrier layer to the substrate 82. Both of these structures are manufactured in a substantially simultaneous manner (e.g. during the same production sequence) from the dual-layer metallic coating 212 which is another feature of the process. The steps which are used to accomplish this goal will now be discussed with reference to the remaining drawing figures.

As illustrated in the figures described below, the upper layer 210 of the second metal within the dual-layer metallic coating 212 is then etched in order to remove a plurality of portions thereof while leaving a plurality of other portions of the upper layer 210 intact. This etching process will also expose multiple regions or zones of the lower layer 208. The term "etching" as used in connection with this step and any other steps in the process shall not be limited to any particular techniques unless otherwise indicated herein. In particular, the term "etching" as employed herein shall broadly encompass any type of process in which the desired materials are selectively removed including any applicable chemical, mechanical, or electrical techniques. General information regarding various etching procedures which may be employed in the steps summarized below is provided in, for example, Elliott, D. J., *Integrated Circuit Fabrication Technology*, McGraw-Hill Book Company, New York (1982) (ISBN No.0-07-019238-3), pp. 245–286 which is again incorporated herein by reference. Exemplary etching techniques which are applicable to an embodiment of the present invention in accordance with the qualifications and guidelines set forth herein include chemical or "wet" etching processes, as well as various "dry" etching methods. Dry etching methods involve, for example, plasma etching, ion beam etching, reactive ion etching, and the like as discussed in the above-listed reference by Elliott. However, preferred and non-limiting examples of various etching techniques (using a number of chemical etchants and other related procedures) will be summarized below with the understanding that these processes are representative only.

Figure 5:
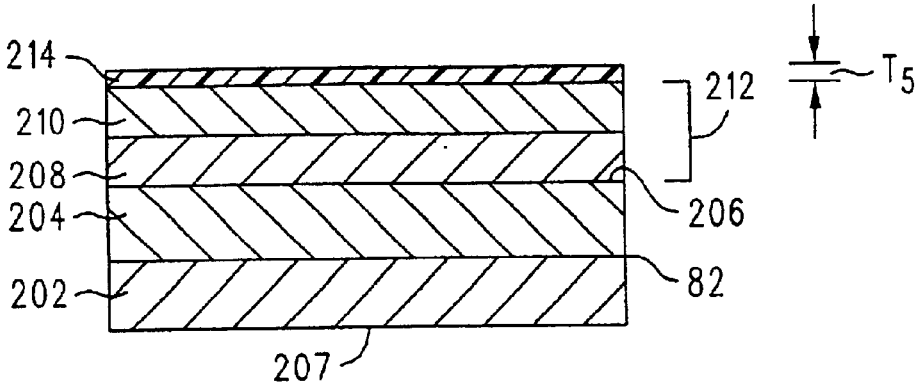

With reference to FIG. 5, the selective removal of various portions of the upper layer 210 of the second metal is accomplished by first applying an initial layer of photoresist material 214 directly on top of the upper layer 210 of the second metal. The layer of photoresist material 214 may involve a number of different compositions without limitation. For example, a representative commercial photoresist composition which can be used at this step is available under the name "OLIN 504" from Olin Microelectronic Materials of East Providence, R.I. (USA). Other photoresist compounds which may be employed at this stage and the other stages discussed below are summarized in Elliott, D. J., *Integrated Circuit Fabrication Technology*, McGraw-Hill Book Company, New York (1982)—(ISBN No. 0-07019238-3), pp. 63–66 which is again incorporated herein by reference. The layer of photoresist material 214 may be applied using a number of different techniques/systems including but not limited to high-speed centrifugal spin coating devices, spray coating units, roller coating systems, and the like. While an embodiment of the present invention shall again not be restricted to any particular thickness values in connection with the various material layers disclosed herein, the layer of photoresist material 214 will have a typical thickness "$T_5$" of about 1.4–2.2 $\mu$m.

Figure 6:
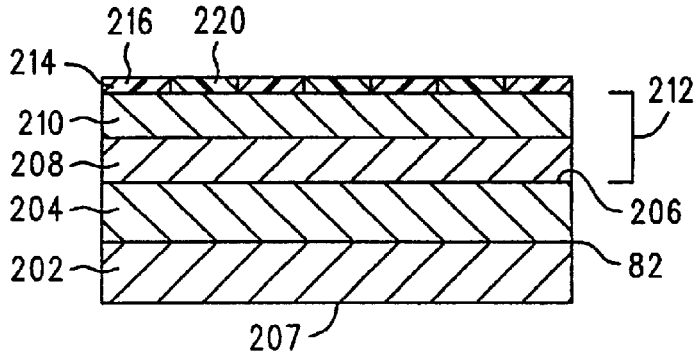
Figure 7:
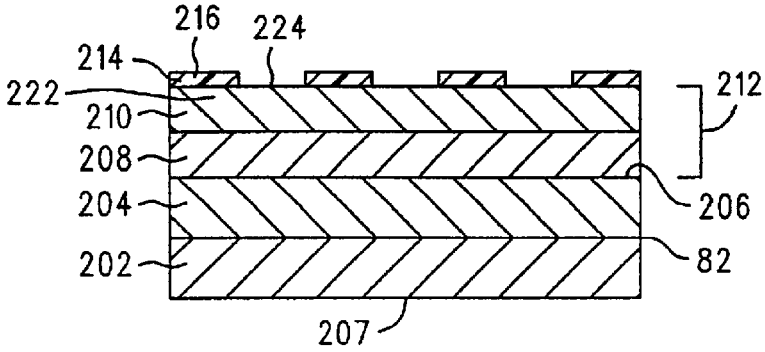

The layer of photoresist material 214 is then imaged in a desired pattern using an appropriate mask (not shown), with this process involving selective illumination of the layer of photoresist material 214 to yield both imaged sections 216 and unimaged sections 220 (FIG. 6) in a desired pattern. In FIG. 6, the cross-hatching of all the imaged sections 216 goes in one direction for illustrative purposes, with the cross-hatching of the unimaged sections 220 going in the opposite direction. The pattern may be varied in order to produce the chosen printhead architecture. The imaged layer of photoresist material 214 is then "developed" chemically in order to "wash away" or otherwise remove the unimaged sections 220 thereof in the present embodiment (with the understanding that this particular process may vary depending on the type of photoresist compositions that are employed). Developer materials which are optimally used for this purpose and in connection with the photoresist materials listed above include but are not limited to a solution of tetramethyl ammonium hydroxide (also known as "TMAH"). Further information regarding the imaging and development process is again provided in Elliott, D. J., *Integrated Circuit Fabrication Technology*, McGraw-Hill Book Company, New York (1982)—(ISBN No.0-07-019238-3), pp. 165–229 (incorporated herein by reference as previously noted.) As a result of the development step outlined above, the structure shown in FIG. 7 is produced in which numerous portions of the layer of photoresist material 214 (namely, the unimaged sections 220) are removed. This structure is then ready for further treatment as discussed below.

The photoimaging processes discussed herein are representative only. A number of different techniques may be employed for this purpose which will achieve equivalent results. In this regard, photoimaging procedures presented herein are discussed in U.S. Pat. No. 5,443,713 and Elliott, D. J., *Integrated Circuit Fabrication Technology*, McGraw-Hill Book Company, New York (1982)—(ISBN No.0-07-019238-3), pp. 43–85, 125–143, and 165–229 (both of which are incorporated herein by reference).

Figure 8:
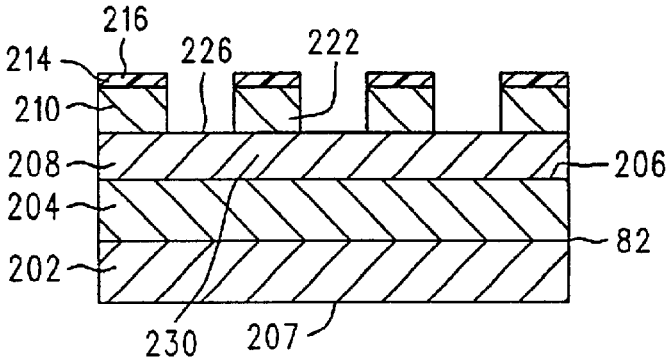

In accordance with the steps listed above, development of the layer of photoresist material 214 produces (1) a plurality of covered portions 222 of the upper layer 210; and (2) a plurality of uncovered portions 224 of the upper layer 210 (FIG. 7), with the terms "covered" and "uncovered" involving the presence or absence of the photoresist material 214 thereon. The next step in a preferred embodiment of the method is shown in FIG. 8. Specifically, the uncovered portions 224 of the upper layer 210 are removed in order to produce a number of exposed regions 226 of the lower layer 208 (e.g. those sections which were previously coated by the uncovered portions 224 of the upper layer 210). Positioned adjacent the exposed regions 226 of the lower layer 208 are multiple unexposed regions 230 of the lower layer 208. The purpose of this step will become readily apparent from the discussion provided below.

Removal of the uncovered portions 224 of the upper layer 210 may be accomplished in many ways without limitation, although the chemical or "wet" etching thereof is preferred. A broad definition of the term "etching" and a number of techniques for doing so are listed above and further discussed in the previously-cited references (including the reference by Elliott). While multiple etching processes can be employed for this purpose, a representative and optimum etching method to be used at this stage will involving the application of a chemical etchant which includes a mixture containing $HNO_3$ (nitric acid), $H_20$, and HCl (hydrochloric acid) in an $HNO_3$:$H_20$:HCl weight ratio of about 3:3:1. Again, a number of different etchants may be employed to remove the uncovered portions 224 of the upper layer 210 depending on the metals being treated as determined by routine preliminary experimentation. At this stage, it is immaterial as to whether the etching process is undertaken in an isotropic or anisotropic manner. "Isotropic etching" is defined to involve a situation in which the material of interest is removed in all exposed directions at the same rate. Conversely, "anisotropic etching" encompasses a process wherein the chosen material is removed at different speeds along different orientations. Further information regarding these etching procedures and what they involve is provided in Wolf, S. et al., *Silicon Processing for the VLSI Era*, Vol. 1 ("Process Technology"), Lattice Press, Sunset Beach, Calif., pp. 520–523 (1986)—(ISBN No. 0-961672-3-7) which is incorporated herein by reference. Further data regarding isotropic etching will be provided below.

In accordance with the etching step employed at this stage of the process which is used to produce the structure shown in FIG. 8, the covered portions 222 of the upper layer 210 (e.g. those portions 222 which are still coated with the layer of photoresist material 214) will remain unaffected (e.g. unetched). Likewise, the entire lower layer 208 also remains completely intact. This is accomplished in accordance with the etching techniques and materials listed above (or other equivalent procedures which are specifically designed to selectively etch the upper layer 210 of the second metal while allowing the lower layer 208 of the first metal to remain unaffected.)

Figure 9:
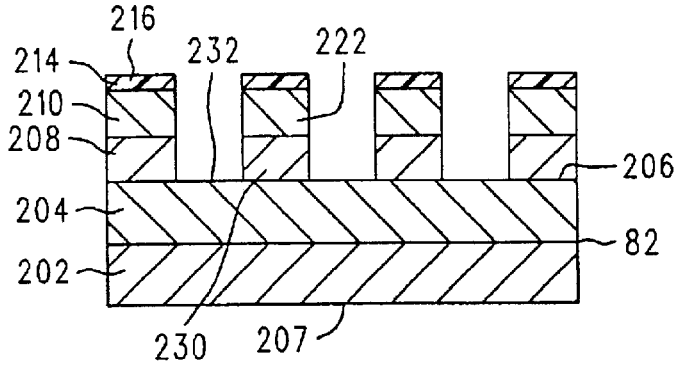
Figure 10:
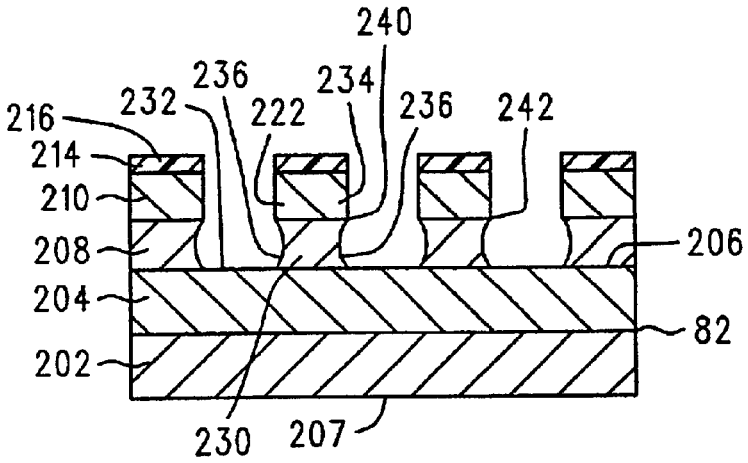

FIGS. 9–10 schematically illustrate the next step in the procedure which is used to produce the high-durability printhead structure. At this point, the exposed regions 226 of the lower layer 208 are removed so that the underlying substrate 82 is uncovered, thereby revealing the upper surface 206 thereof. The uncovered or "exposed" portions of the substrate which are produced in this step are designated at reference number 232 in FIGS. 9–10 (discussed in further detail below). However, as will become readily apparent from the information provided in this section of the current discussion, the processing steps associated with FIGS. 9–10 are conducted in a unique manner which ultimately generates at least one or more specially-constructed anchor members. These anchor members provide the benefits listed above including the secure attachment of the ink barrier layer to the underlying substrate 82, and in one embodiment, to the components on the substrate upper surface 84.

To produce the anchor members, the exposed regions 226 of the lower layer 208 are isotropically-etched. Isotropic etching is defined above and again discussed in the Wolf, S. et al. reference. As a result of this procedure, each of the completed anchor members described in considerable detail below (which shall again be designated herein as "isotropically-etched" structures) will include (1) a substantially planar upper face; (2) a substantially planar lower face; and (3) a central or medial portion with a side wall having a surface which extends inwardly into the anchor member at one or more positions thereon. In a preferred embodiment, the side wall will be concave in character although the term "isotropically-etched" shall be construed to generally encompass a situation in which the width of the anchor member at one or more positions along the central portion/side wall is less than the width of the anchor member at both the upper and lower faces thereof. This special configuration will again be reviewed in detail below.

The isotropic etching process can be accomplished in a number of different ways, with an embodiment of the present invention not being restricted to any given techniques for this purpose. Isotropic etching may be achieved in one or multiple stages as outlined below, with the term "isotropic etching" involving any process in which the structures which remain after etching (e.g. the anchor members) have an "isotropic" character, namely, side walls which extend inwardly to form a concave or equivalent configuration. However, for example purposes, the following approaches can be employed in order to achieve isotropic etching so that the anchor members can be fabricated:

Approach No. 1

This technique basically involves a two-step method wherein an anisotropic "dry" etching stage is first undertaken in order to produce the structure shown in FIG. 9, followed by an isotropic "wet " etching process which results in the isotropically-etched structures presented in FIG. 10. Specifically, in a preferred and non-limiting embodiment, the initial anisotropic etching step is completed using a chlorine-based system wherein a plasma containing chlorine is used to etch away the exposed underlying metal (e.g. the exposed regions 226 of the lower layer 208). As a result, the structure of FIG. 9 is produced in which the exposed regions 226 of the lower layer 208 are eliminated. The total time period associated with this etching step is about 0.5–1.5 minutes in a preferred and non-limiting embodiment. At this point, all of the components illustrated in FIG. 9 have linear (anisotropic) side wall/side edge characteristics. Immediately thereafter, the etching stage started in FIG. 9 is continued in an isotropic manner using a "wet" etching procedure in which an etchant is employed comprising a mixture of HOAc (acetic acid), $HNO_3$ (nitric acid), and HF (hydrofluoric acid) in an HOAc: $HNO_3$: HF weight ratio of about 30:1:5. Application of the foregoing etchant (or other equivalent chemical compositions) to the structure of FIG. 9 will generate the isotropically-etched components shown in FIG. 10 and discussed in substantial detail below. A preferred, non-limiting time period associated with this etching step is about 2–3 minutes.

Approach No. 2

The particular technique associated with this approach employs a single step that leads directly to the structures and components presented in FIG. 10 (without the intermediate stage associated with FIG. 9). To accomplish this goal, an etchant is applied directly to the structure of FIG. 8 in a "wet" isotropic process, with the etchant comprising a mixture of HOAc (acetic acid), $HNO_3$ (nitric acid), and HF (hydrofluoric acid) in an HOAc:$HNO_3$: HF weight ratio of about 30:1:10. The application of this etchant (or other equivalent chemical compositions) to the structure of FIG. 8 will directly generate the isotropically-etched components shown in FIG. 10 as noted above. A preferred, non-limiting time period associated with this etching step is about 2.5–4 minutes.

Both of the approaches listed above shall be considered "isotropic" since they employ a "final" processing stage in which etching is completed on an isotropic basis. Both techniques are therefore equivalent from a functional standpoint. Again, a number of different single-stage or multi-stage procedures can be used to accomplish isotropic etching, with the examples provided herein being representative only. The selection of any given isotropic etching technique (and the number of steps associated therewith) will be chosen in accordance with preliminary pilot testing involving numerous parameters including but not limited to the particular construction materials being employed and the desired manufacturing scale associated with the printhead of interest. Thus, an embodiment of the present invention shall not be considered "production technique specific" as previously stated.

Regardless of which approach is selected to accomplish isotropic etching, the resulting isotropically-etched structures are again illustrated in FIG. 10 which will now be discussed in detail. As shown in FIG. 10, each of the remaining components which reside on the upper surface 206 of the substrate 82 is characterized as an "upwardly-extending structure" 234. Each of the upwardly-extending structures 234 on the substrate 82 in the embodiment of FIG. 10 are separated from each other by the exposed portions 232 of the substrate 82. Each upwardly-extending structure 234 basically includes (A) one of the covered regions 222 of the upper layer 210 (e.g. which, at this stage, is still coated with the layer of photoresist material 214); and (2) one of the unexposed (e.g. covered) regions 230 of the lower layer 208 which has been isotropically-etched in an inwardly fashion as illustrated in FIG. 10 to produce concave, arcuate side walls 236. At this point, it shall be understood that each of the upwardly-extending structures 234 will ultimately become (1) the elongate conductive circuit elements 90 (or "bus members"); or (2) one of the anchor members of an embodiment of the present invention, depending on the next step in the process. Regarding the isotropically-etched character of the regions 230 of the lower layer 208 shown in FIG. 10, the physical and structural characteristics thereof which result from isotropic etching will be discussed in substantial detail below.

The next step in the process involves a determination as to which of the upwardly-extending structures 234 will become anchor members and which of them will function as the circuit elements 90. The number of anchor members and circuit elements 90 which are produced in accordance with an embodiment of the invention will vary and shall be determined on a case-by-case basis depending on the type of printhead under consideration and other extrinsic factors. In this regard, an embodiment of the present invention shall not be restricted to any particular quantity of anchor members and/or circuit elements 90 provided that the completed printhead 80 includes at least one anchor member and at least one circuit element 90. Further data regarding quantity values in connection with, for example, the anchor members will be provided below.

After a determination has been made involving the number of anchor members and circuit elements 90 to be employed on the substrate 82, the upwardly-extending structures 234 that are chosen to become anchor members are treated to remove the upper layer 210 of the second metal therefrom. These "selected" structures 234 are further designated in FIG. 10 at reference numbers 240, 242. Conversely, the upwardly-extending structures 234 which are chosen to become circuit elements 90 do not undergo any further metal removal steps. Accordingly, these particular upwardly-extending structures 234 shall hereinafter be designated as the completed circuit elements 90 (or "bus members" as previously noted).

Figure 11:
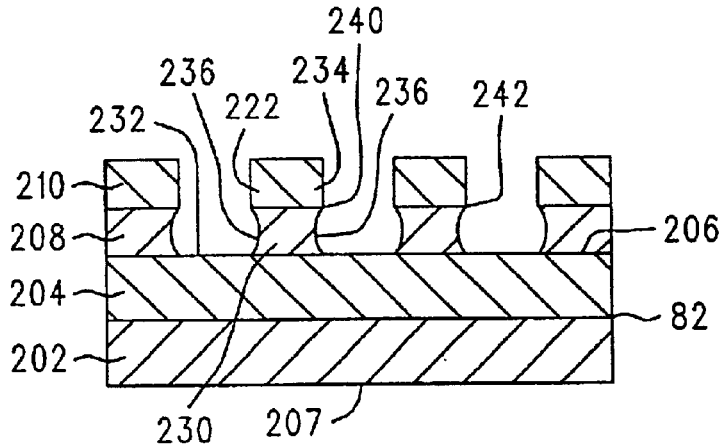
Figure 12:
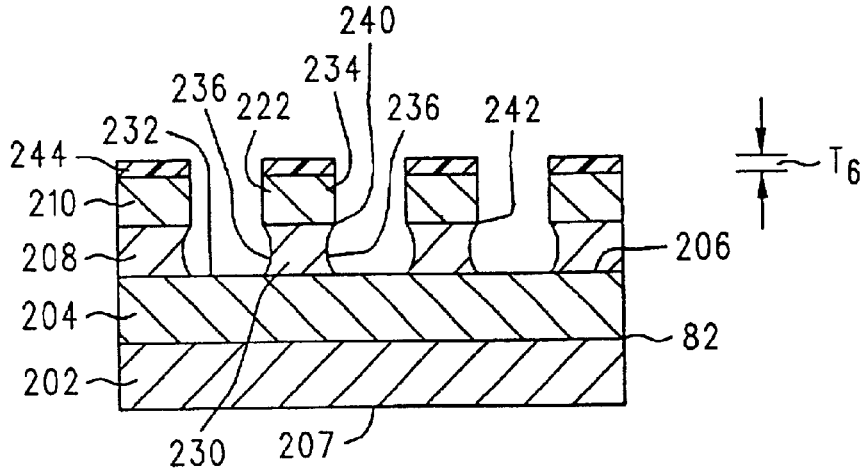

To produce the anchor members of an embodiment of the present invention from the upwardly-extending structures 234 which are selected for this purpose (e.g. structures 240, 242), the initial layer of photoresist material 214 is first removed from all of the upwardly-extending structures 234 on the substrate 82 as illustrated in FIG. 11. This is typically accomplished by the application of solvent materials (e.g. a commercial product sold under the designation "PRS-1000" by Mallinckrodt Baker of Phillipsburg N.J. [USA]), acids (e.g. sulfuric acid [$H_2SO_4$]), hydrogen peroxide ($H_2O_2$), combinations thereof, or an oxygen plasma. Next, as indicated in FIG. 12, an additional layer of photoresist material 244 is delivered onto all of the upwardly-extending structures 234. The additional layer of photoresist material 244 may involve a number of different compositions without limitation. For example, a representative compound which may be used as the additional layer of photoresist material 244 is the same composition described herein in connection with the initial layer of photoresist material 214. Other representative photoresist compounds which can be employed for this purpose are discussed in Elliott, D. J., *Integrated Circuit Fabrication Technology*, McGraw-Hill Book Company, New York (1982)—(ISBN No. 0-07019238-3), pp. 63–66 which is again incorporated herein by reference. The additional layer of photoresist material 244 may likewise be applied using a number of different techniques/systems including but not limited to high-speed centrifugal spin coating devices, spray coating units, roller coating systems, and the like. While an embodiment of the present invention shall again not be restricted to any particular thickness values in connection with the various material layers disclosed herein, the additional layer of photoresist material 244 will have a typical thickness "$T_6$" (FIG. 12) of about 1.4–2.2 $\mu$m which is substantially the same as the thickness "$T_5$" of the initial layer of photoresist material 214 discussed above.

Figure 13:
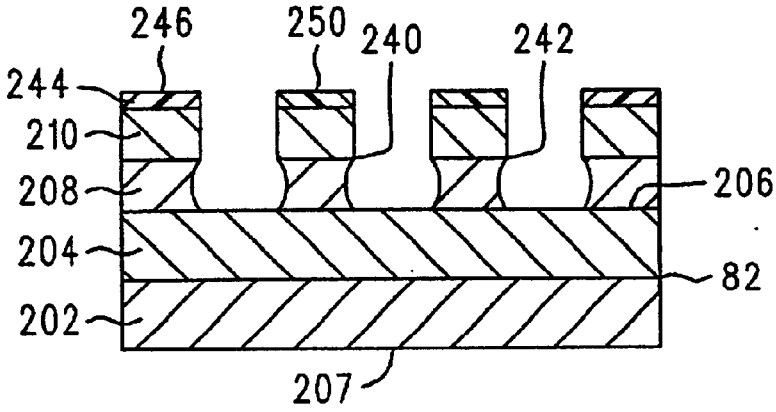

The additional layer of photoresist material 244 is then imaged in a desired pattern using an appropriate mask (not shown), with this process involving selective illumination of the additional layer of photoresist material 244 to yield both imaged sections 246 and unimaged sections 250 (FIG. 13). In FIG. 13, the cross-hatching of all the imaged sections 246 goes in one direction for illustrative purposes, with the cross-hatching of the unimaged sections 250 going in the opposite direction. In the embodiment of FIG. 13, the unimaged sections 250 of the photoresist material 244 are located on the upwardly-extending structures 234 which will ultimately become the anchor members of an embodiment of the present invention (namely, structures 240, 242). The additional layer of photoresist material 244 is then "developed" chemically in order to "wash away" or otherwise remove the unimaged sections 250 thereof in the present embodiment (with the understanding that this particular process may vary depending on the type of photoresist compositions that are employed). Developer compositions which are optimally used for this purpose and in connection with the photoresist material 244 listed above include but are not limited to those which were employed in connection with the initial layer of photoresist material 214. Further information regarding the imaging and development process is again provided in Elliott, D. J., *Integrated Circuit Fabrication Technology*, McGraw-Hill Book Company, New York (1982)—(ISBN No. 0-07-019238-3), pp. 165 –229 (incorporated herein by reference as previously noted.)

Figure 14:
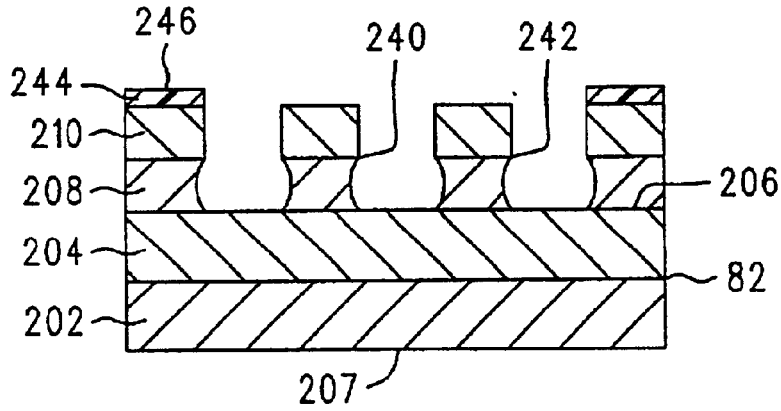

As a result of the development step outlined above, the basic structure shown in FIG. 14 is produced in which various portions of the additional layer of photoresist material 244 (namely, the unimaged sections 250) are removed. Thereafter, the upwardly-extending structures 240, 242 which are designated to become anchor members are processed in order to remove the upper layer 210 of the second metal therefrom. This step may be accomplished using a number of etching procedures including the "wet" and "dry" techniques listed above in accordance with the broad definition of "etching" provided herein. Further etching processes which may be used at this stage include those recited in Elliott, D. J., *Integrated Circuit Fabrication Technology*, McGraw-Hill Book Company, New York (1982)—(ISBN No. 0-07-019238-3), pp. 245 –286 which is again incorporated herein by reference. In a representative and non-limiting embodiment, etching of the upper layer 210 of the second metal from the upwardly-extending structures 240, 242 illustrated in FIG. 14 is accomplished in an anisotropic manner by applying a chemical etchant thereto which includes a mixture containing $HNO_3$ (nitric acid), $H_20$, and HCl (hydrochloric acid) in an $HNO_3$: $H_20$:HCl weight ratio of about 3:3:1. Again, a number of different etchants may be employed for this purpose depending on the metals being removed as determined by routine preliminary experimentation. At this stage, it is immaterial as to whether the etching process is undertaken in an isotropic or anisotropic manner.

Figure 15:
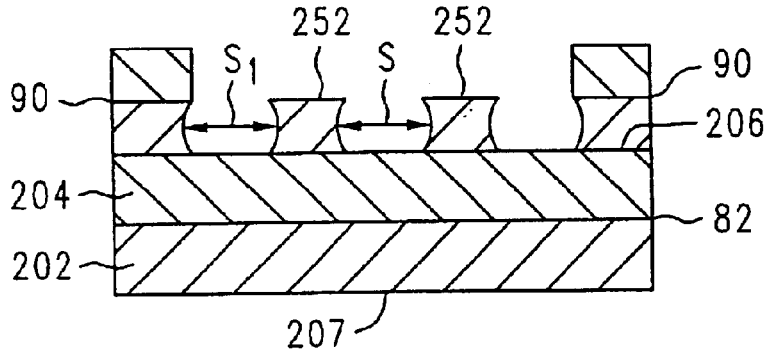

After etching, the resulting structure is illustrated in FIG. 15. This structure includes the anchor members (designated at reference number 252) and the circuit elements 90 thereon. It should be noted that the finished unit presented in FIG. 15 was likewise previously treated to remove the imaged sections 246 of the additional layer of photoresist material 244 from the upwardly-extending structures 234 which now function as the circuit elements 90. This was preferably accomplished in the same manner that was used to remove the initial layer of photoresist material 214 to produce the structure of FIG. 11 as discussed above.

Figure 16:
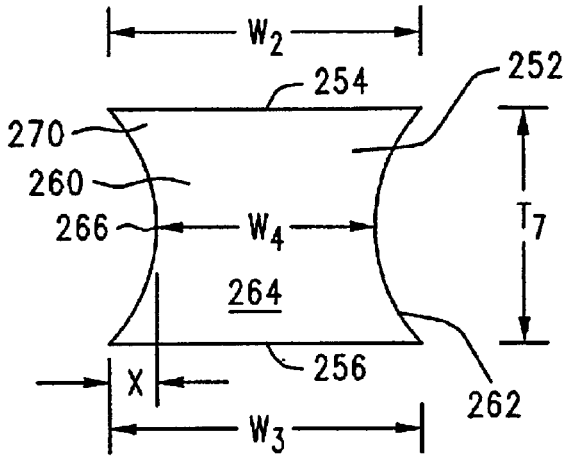
FIG. 16 is an enlarged schematic side view of a representative isotropically-etched circular anchor member produced in accordance with a preferred embodiment of the invention.
Figure 17:
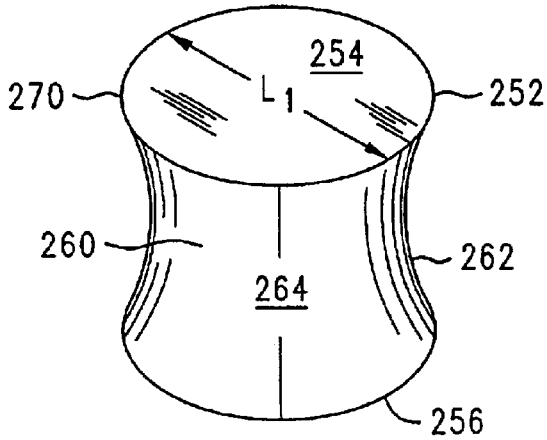
FIG. 17 is a top perspective view of the anchor member of FIG. 16.
Figure 18:
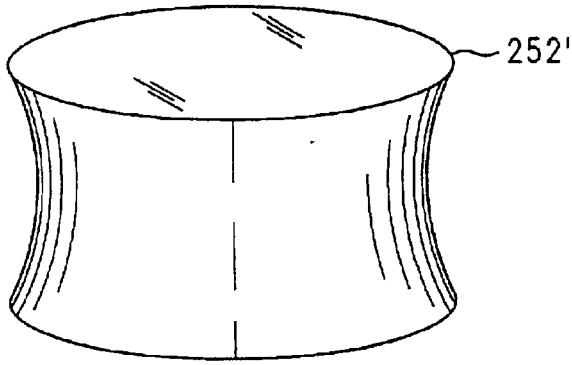
FIG. 18 is a top perspective view of a non-circular anchor member produced in accordance with an alternative embodiment of the invention.

The anchor members of an embodiment of the present invention are again illustrated at reference number 252 in FIG. 15. The other components shown in FIG. 15 involve the circuit elements 90 or "bus members." The anchor members 252 (which are used to hold the ink barrier layer on the substrate 82) have a unique structural configuration which will now be discussed in considerable detail. With reference to FIGS. 16–17, enlarged views of a representative anchor member 252 produced in accordance with the process is shown in enlarged format. In a preferred embodiment, each anchor member 252 is fabricated using the masking and etching steps listed above so that it is substantially circular in cross-section, thereby forming a "peg-like" structure with an "hourglass" shape in accordance with the perspective view of FIG. 17. However, as illustrated in FIG. 18, other configurations are possible including but not limited to the elongate "ovoid" anchor member 252' shown in this figure. Regardless of which overall design is employed in connection with the anchor members of an embodiment of the present invention, the structures are all related by a common feature, namely, the presence of a circumferential side wall (namely, a wall or surface extending around the entire structure) wherein all or part of the wall/surface is isotropically-etched in an inward fashion. The definition of "isotropically-etched" is provided above and incorporated by reference in the present discussion. While a number of different anchor members may be produced within the scope of an embodiment of the present invention, the remainder of this description shall involve the circular, "peg-like" anchor member 252 illustrated in FIGS. 16–17.

With continued reference to FIGS. 16–17, the anchor member 252 includes a substantially flat/planar upper face 254 and a substantially flat/planar lower face 256, with both faces 254, 256 being parallel to each other and preferably of equal size as a result of the fabrication process discussed above. Positioned between the upper and lower faces 254, 256 is a central or medial portion 260 which is circumferentially surrounded by a side wall 262. The side wall 262 includes an exterior surface 264 (FIG. 16) having a concave, inwardly-directed character which, as noted above, is a direct result of the isotropic etching process. In a preferred embodiment, the concave side wall 262/surface 264 extends entirely around the anchor member 252 in order to provide a maximum degree of anchoring effectiveness. However, it shall again be understood that an embodiment of the present invention and the term "isotropically-etched" will encompass any design in which the width of the anchor member 252 at any one or more positions taken along the side wall 262 of the medial portion 260 is less than the width of the anchor member 252 at (1) the upper face 254; and (2) the lower face 256. For example, as illustrated in FIG. 16, the width "$W_2$" of the anchor member 252 at the upper face 254 thereof and the width "$W_3$" of the anchor member 252 at the lower face 256 are both greater than the width "$W_4$" of the medial portion 260 measured at position 266 (which represents the longitudinal midpoint of the anchor member 252 and is the position of minimal width in accordance with the concave circular character of the side wall 262). With continued reference to FIG. 16, the width "$W_2$" of the anchor member 252 at the upper face 254 thereof and the width "$W_3$" of the anchor member 252 at the lower face 256 (which is substantially the same as "$W_2$") are likewise both greater than the width of the medial portion 260 taken at any position along the length of this structure due to the uniformly concave character of the side wall 262/surface 264. In the embodiment of FIG. 16, the following representative and non-limiting width values provide excellent results: (A) "$W_2$"=about 2–10 μm (about 5 μm=optimum); (B) "$W_2$"= "$W_3$"; and (C) "$W_4$"=about 1.8–9.9 μm (about 3 μm =optimum). However, the relationships and parameters listed above are again provided for example purposes only and shall not limit the invention in any respect. Likewise, as previously noted, the side wall 262/surface 264 of the anchor member 252 shall not be restricted to a concave configuration and will again encompass any design in which at least one part of the medial portion 260 (e.g. at least one point thereon) has a width which is less than the width of the anchor member 252 taken at the upper face 254 and lower face 256 as previously noted. This particular design can encompass many different configurations ranging from the concave structure of FIGS. 16–17 to anchor members in which an inwardly-indented "dimple" (not shown) is formed at one or more locations on the side wall 262 of the medial portion 260. Thus, anchor members having any design incorporated within the broad definition of "isotropically-etched" provided herein will be encompassed within an embodiment of this invention. All of these designs are again related by the presence of at least one indented or depressed region therein which is adapted to receive the ink barrier material when it is applied to the substrate 82. During this application process as discussed in greater detail below, the ink barrier material will flow into the indented region(s) and thereafter solidify. As result, the ink barrier material is "locked" into the indented region(s) of the anchor member 252, thereby securing both components together.

The thickness "$T_7$" of the anchor member 252 (FIG. 16) will be substantially identical to the thickness "$T_3$" (FIG. 3) of the lower layer 208 of the first metal (e.g. about 0.3–1.0 μm) since the anchor member 252 is directly fabricated from the lower layer 208. Again, this value (and the other parameters expressed herein) may be varied in accordance with routine preliminary pilot studies on the particular printhead of interest. In accordance with the concave character of the side wall 262 and surface 264 associated therewith (which is a direct result of the isotropic etching process), the anchor member 252 further includes a circumferential outwardly-projecting region 270 adjacent the upper face 254. In use, the outwardly-projecting region 270 extends into the ink barrier material (discussed below) to retain it in position on the substrate 82. Likewise, as shown in FIG. 16, the concave exterior surface 264 of the side wall 262 will have a preferred inward depth "X" of about 0.05–0.1 μm in a representative embodiment, with depth "X" being measured at point 266. Point 266 again represents the longitudinal midpoint of the anchor member 252. The structure presented in FIG. 16 (which again represents a preferred version of the invention) will also have a side wall 262/concave exterior surface 264 with an optimum radius of curvature of about 0.3–0.7 μm, with the term "radius of curvature" being defined to generally involve the radius of the circle of curvature at a point of a curve. However, these values may again be varied and are likewise subject to change based on the type of etching process which is employed and the degree to which etching is allowed to proceed.

Regarding the overall length "$L_1$" of the anchor member 252 shown in FIG. 17, this parameter will be substantially identical to the width "$W_2$" of the upper face 254, the width "$W_3$" of the lower face 256, and the maximum diameter of the anchor member 252 (e.g. the diameter at the largest portion of the anchor member 252) due to the symmetrical/circular cross-sectional character of this structure. However, the length of any given anchor member produced in accordance with an embodiment of the invention will vary depending on the overall shape of the anchor member as determined by routine preliminary testing. In this regard, the ovoid anchor member 252' of FIG. 18 and its differing length characteristics are noted.

The spacing of the anchor members 252 relative to each other and the other components on the substrate 82 may be varied. The ultimate orientation of the anchor members 252 will depend on numerous factors including the overall architecture associated with the printhead and the size thereof, as well as the number of anchor members 252 under consideration. In the representative, non-limiting embodiment of FIG. 15, each of the anchor members 252 are spaced apart from each other by a distance "S" of about 2–10 μm. The relative distance between the anchor members 252 and the other structures on the substrate 82 (namely, the elongated conductive circuit elements 90) will be discussed further below. However, the presence of even a single anchor member 252 located anywhere on the substrate 82 where the barrier layer is present will provide the benefits listed above including improved durability and structural integrity.

The upwardly-extending structures 234 which did not become the anchor members 252 are again designated herein at reference number 90 (FIG. 15) since these structures will now function as the elongate conductive circuit elements 90. As previously described, the circuit elements 90 electrically communicate with the ink ejectors (e.g. the resistors 86 in the preferred embodiment of FIG. 1) and are able to deliver appropriate electrical signals to these components so that accurate and effective on-demand printing can occur. In the embodiment of FIG. 15, the circuit elements 90 which are located next to an anchor member 252 are optimally separated from each other by a representative and non-limiting distance "$S_1$" of about 2–100 μm. However, this range and the respective locations of the anchor members 252 and circuit elements 90 on the substrate 82 can again be varied in accordance with routine preliminary testing.

Figure 19:
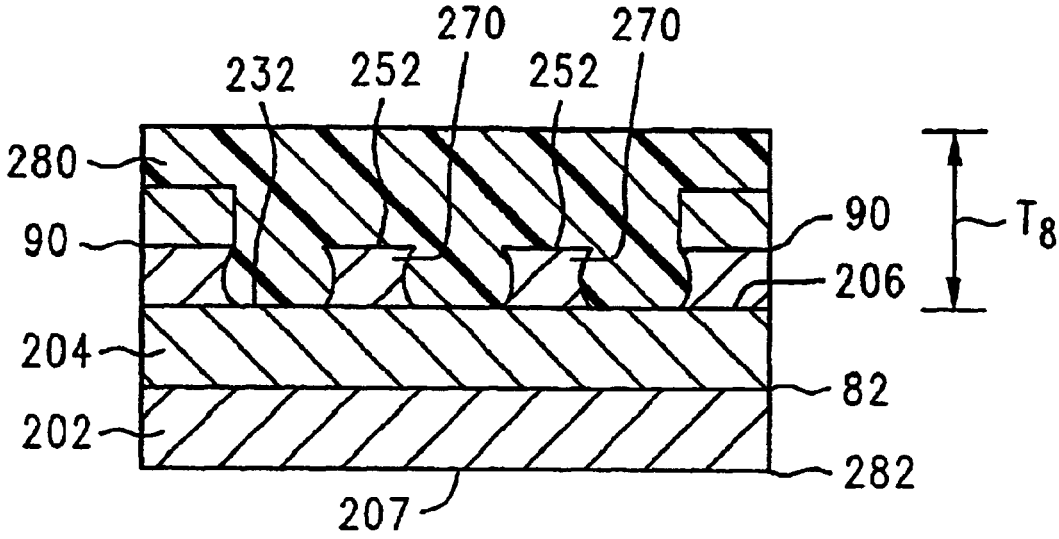
FIG. 19 is a cross-sectional schematic view which illustrates the completed printhead structure of an embodiment of the present invention in which the ink barrier layer is secured in position using the anchor members.

The final step in the production process of an embodiment of the present invention is shown schematically in FIG. 19. In this figure, a layer of ink barrier material 280 (also designated herein as an "ink barrier layer" or "chamber layer") is positioned partially or (in a preferred embodiment) completely over all of the components listed above including the circuit elements 90 and anchor members 252. The layer of ink barrier material 280 performs a number of functions in the printhead 80 including electrical insulation of the circuit elements 90 so that short circuits and physical damage to these components are prevented. In particular, the ink barrier material 280 functions as an electrical insulator and "sealant" which covers the circuit elements 90 and prevents them from coming in contact with the ink compositions being delivered. The layer of ink barrier material 280 also protects the components thereunder from physical shock and abrasion damage. These benefits ensure consistent and long-term operation of the printhead 80. Many different chemical compositions may be employed in connection with the layer of ink barrier material 280, with high-dielectric organic compounds (e.g. polymers or monomers) being preferred. Representative organic materials which are suitable for this purpose include but are not limited to commercially-available acrylate photoresists, photoimagable polyimides, thermoplastic adhesives, and other comparable materials which are known in the art for ink barrier layer use. For example, the following representative, non-limiting compounds suitable for fabricating the ink barrier layer 280 are as follows: (1) dry photoresist films containing half acrylol esters of bis-phenol; (2) epoxy monomers; (3) acrylic and melamine monomers [e.g. those which are sold under the trademark "Vacrel" by E. I. DuPont de Nemours and Company of Wilmington, Del. (U.S.A.)]; and (4) epoxy-acrylate monomers [e.g. those which are sold under the trademark "Parad" by E. I. DuPont de Nemours and Company of Wilmington, Del. (USA)]. Further information regarding barrier materials is provided in U.S. Pat. No. 5,278,584 and a reference entitled Mrvos, J., et al., "Material Selection and Evaluation for the Lexmark 7000 Printhead", 1998 International Conference on Digital Printing Technologies, *Imaging Science and Technology-Non Impact Printing*, Vol. 14, pp. 85–88 (1998) which are both incorporated herein by reference.

The invention shall not be restricted to any particular barrier compositions or methods for delivering the ink barrier material 280 to the substrate 82. Regarding preferred application methods, the layer of ink barrier material 280 is delivered to the substrate 82 by high speed centrifugal spin coating devices, spray coating units, roller coating systems and the like. However, the particular application method for any given situation will depend on the ink barrier material 280 under consideration.

As illustrated in FIG. 19 and indicated above, the layer of ink barrier material 280 effectively covers all of the structures in this figure in order to achieve the benefits listed above. In printhead systems, the bond between the ink barrier layer and underlying substrate is believed to be one of the weakest links in the entire printhead. Inadequate affixation of the ink barrier layer to the substrate typically resulted in partial or complete detachment of these components from each other causing numerous problems. These problems included (1) ink "shorts" in which ink from the firing chamber and other regions in the printhead "wicked" into any gaps between the circuit elements and detached ink barrier layer; and/or (2) undesired architecture changes within the firing chambers. Printhead units experiencing these problems were prone to improper ink drop ejection, decreased longevity, and an overall deterioration in operational efficiency.

In contrast, an embodiment of the present invention avoids the problems listed above by securely attaching the layer of ink barrier material 280 to the substrate 82 using the anchor members 252. The anchor members 252 effectively "grip" the layer of ink barrier material 280 and physically hold it in position as shown in FIG. 19. In particular, the circumferential outwardly-projecting region 270 of each anchor member 252 (FIG. 19) engages the layer of ink barrier material 280 as it flows around the anchor member 252 during application. Thus, the anchor members 252 impart a high degree of structural integrity to the entire printhead 80 by strongly securing the layer of ink barrier material 280 in position.

As previously noted, the process shall not be restricted to any particular methods for applying the layer of ink barrier material 280 in position on the substrate 82. However, in a preferred embodiment designed to provide optimum results, the layer of ink barrier material 280 is first applied to the substrate 82 in the manner discussed above, with the ink barrier material 280 covering the substrate 82, circuit elements 90, and anchor members 252. So that the ink barrier material 280 will effectively flow around the anchor members 252 and concave regions associated therewith as previously noted, the ink barrier material 280 is preferably heated during or after application to a temperature of about 50–500° C. This range is applicable to the ink barrier compositions listed above and other equivalent materials known in the art for printhead construction. Heating (which optimally occurs after application of the ink barrier layer 280 to the substrate 82) may be achieved in many different ways. For example, the substrate 82 and layer of ink barrier material 280 thereon may be placed into a standard oven suitable for this purpose. This supplemental heating step (which is optional but preferred) again causes the ink barrier material 280 to soften and effectively flow entirely around each anchor member 252. In this manner, intimate and complete contact begin the anchor members 252 and the ink barrier material 280 is assured which further enhances the ability of the anchor members 252 to "grip" the barrier material 280 and prevent it from detaching. Likewise, the heating step described above prevents the formation of gaps between the layer of ink barrier material 280 and the substrate 82.

With continued reference to FIG. 19, the layer of ink barrier material 280 has an optimal and preferred thickness "$T_8$" of about 4–60 $\mu$m in a representative embodiment. This value is subject to variation in accordance with routine preliminary testing taking into account the particular type of printhead under consideration. Regardless of the selected thickness value, it is again preferred that the ink barrier material 280 entirely cover all of the components described above. After this step, the remaining printhead assembly steps are completed. While many different procedures are applicable at this point, the step of primary interest involves placement of the office plate 104 (FIG. 1) in position on the structure of FIG. 19 so that the orifices 108 in the plate 104 are properly aligned with the underlying ink ejectors. As shown in the embodiment of FIG. 1, the ink ejectors involve the resistor elements 86. Attachment of the orifice plate 104 is accomplished by applying at least one adhesive compound to the layer of ink barrier material 280, the underside of the orifice plate 104, or both of these components. Representative adhesive materials suitable for this purpose include but are not limited to cyanoacrylate compounds, known epoxy resin compositions, silane coupling agents, and mixtures thereof.

The completed structure of an embodiment of the present invention shown at reference number 282 in FIG. 19 again includes the following key elements: (1) at least one isotropically-etched upwardly-extending metallic anchor member 252 positioned on a portion of the substrate 82 surrounding the ink ejectors of interest (e.g. the resistor elements 86 or other comparable structures); and (2) a layer of at least one ink barrier material 280 (preferably made of an organic polymer or monomer composition) which covers the anchor member 252. The isotropically-etched character of the anchor member 252 securely attaches the ink barrier material 280 to the substrate 82. In a preferred embodiment, the anchor member 252 will be made of the first metal discussed above, and will have a thickness within the previously-described range. Likewise, the completed structure 282 will also optimally include at least one elongate conductive circuit element 90 (e.g. "bus member") positioned on another portion of the substrate 82 surrounding the ink ejectors, with the circuit element 90 being made of the second metal discussed above which (in a preferred embodiment) is different from the first metal. Each circuit element 90 is preferably secured to the substrate 82 using an intermediate portion of material positioned therebetween which is comprised of the first metal. In the structure 282, the layer of ink barrier material 280 covers the circuit elements 90, anchor members 252, and any exposed portions 232 of the substrate 82 therebetween, with the anchor members 252 securely attaching the ink barrier material 280 to the substrate 82 as previously noted.

Having herein set forth preferred embodiments of the invention, it is anticipated that suitable modifications may be made thereto by individuals skilled in the relevant art which nonetheless remain within the scope of the invention. For example, the invention shall not be limited to any particular ink delivery systems, ink ejectors, operational parameters, dimensions, ink compositions, construction materials, and component orientations unless otherwise stated herein. Any number, location, size, and position of the anchor members may be employed without limitation. The invention shall also not be restricted to any particular internal circuitry, with any type of signal transmission system being applicable provided that an embodiment of the present invention includes at least one isotropically-etched anchor member which is covered by a layer of an ink barrier material. It is also contemplated that one or more additional layers of material can be placed between the substrate and the anchor members of an embodiment of the invention. Thus, when it is indicated that the anchor members are "positioned" or "formed" on the substrate, this situation will encompass (1) attachment of the anchor members directly to the substrate without any intervening materials therebetween; and/or (2) placement of the anchor members on the substrate with one or more layers of intervening material (metals or otherwise) between the substrate and anchor members, with both of these situations being considered equivalent.

For example, in an alternative embodiment, at least one layer of metal (or dual layers as discussed above) may first be applied to the substrate 82 for a number of different purposes without restriction including fabrication of the elongate conductive circuit elements 90 described herein. The metals which can be employed for this purpose are the same as those previously recited herein including but not limited to gold (Au), tantalum (Ta), aluminum (Al), rhodium (Rh), chromium (Cr), titanium (Ti), molybdenum (Mo), and mixtures thereof. Thereafter, at least one isotropically-etched upwardly-extending metallic anchor member 252 of the type described above is placed on the foregoing layer or layers of metal. If a plurality of metal layers are employed which are ultimately configured to produce one or more of the elongate conductive circuit elements 90, then the anchor member 252 is positioned directly on top of the circuit element(s) 90 of interest. Fabrication of the metal layers/elongate conductive circuit elements 90 is accomplished as previously noted or using equivalent processes. Likewise, the specific steps which are employed to produce the anchor members 252 in this alternative embodiment are the same as those discussed in connection with the primary embodiment, except that the previously-described processing steps are implemented on top of the metal layer(s) of interest in the present embodiment. Thus, all of the data, procedures, construction materials, and other parameters associated with the primary embodiment concerning these production steps are equally applicable to this embodiment and are incorporated by reference relative thereto.

Figure 20:
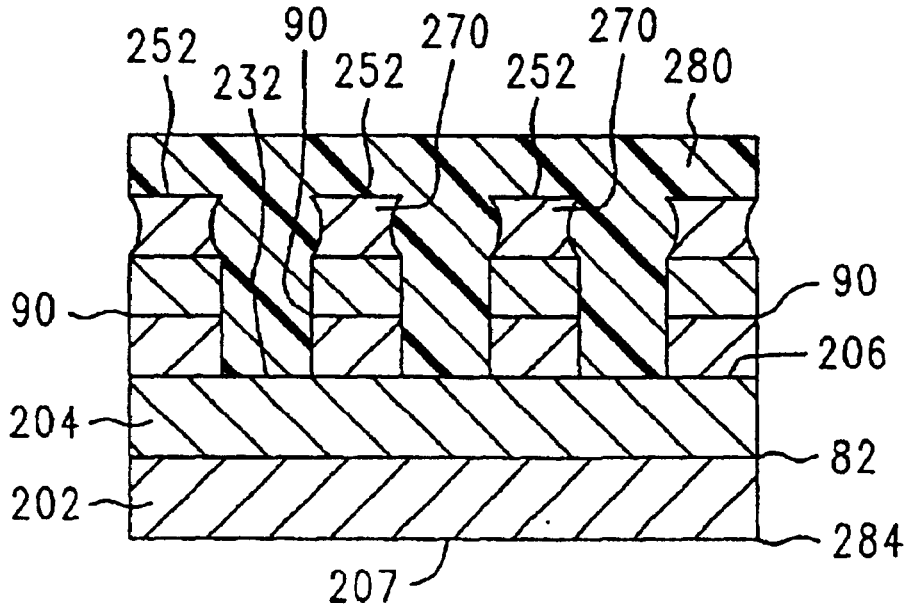
FIG. 20 is a cross-sectional schematic view which illustrates the completed printhead structure in an alternative embodiment of the invention in which the ink barrier layer is secured in position using the anchor members, with the anchor members being located on top of one or more intervening metallic structures.

This alternative embodiment is illustrated schematically in FIG. 20 with the understanding that it is representative only with a number of variations being possible (especially in connection with the metal layer(s) located between the substrate 82 and the anchor members 252). In the system of FIG. 20, the structure of FIG. 9 (minus the initial layer of photoresist material 214 thereon) is illustrated. The layer of photoresist material 214 is optimally removed from the structure of FIG. 9 in the same manner which was used to remove it from the structure of FIG. 10. Thereafter, the process steps shown in FIGS. 2–15 and discussed above are implemented in order to fabricate the anchor members 252 on some or all of the components illustrated in FIG. 9. Thus, all of the information provided above in the first embodiment regarding fabrication of the anchor members 252 is equally applicable to this embodiment, except that the layering, etching, and other processes associated with anchor member production occur on top of the structures shown in FIG. 9 (which are made from the dual-layer metallic coating 212.) As a result of this process, the alternative unit 284 is illustrated in FIG. 20 with the layer of ink barrier material 280 thereon. In the embodiment of FIG. 20, all of the elongate conductive circuit elements 90 have an anchor member 252 thereon. In other versions of this embodiment, only some of the circuit elements 90 will be covered by anchor members 252 (i.e. have an anchor member 252 thereon). All of the dimensions associated with the first embodiment are equally applicable to and incorporated by reference relative to the present embodiment, with such dimensions again being subject to change in accordance with the particular printhead under consideration. For example, the thickness of the ink barrier layer 280 may be increased to accommodate the additional components in unit 284.

The completed unit 284 will include (1) a substrate having at least one ink ejector thereon defined earlier in this section; (2) at least one layer of metal positioned on a portion or part of the substrate 82 at a location thereon which surrounds the ink ejector (either in one or more discrete layers or configured to produce the elongate conductive circuit elements 90); (3) at least one isotropically-etched upwardly-extending metallic anchor member 252 placed on the selected layer(s) of metal (or circuit elements 90), with the anchor member 252 optimally being produced from the first metal described herein; and (4) a layer of at least one ink barrier material 280 (optimally made of an organic polymer or monomer compound) covering the layer(s) of metal, the anchor member(s) 252, and any exposed portions 232 of the substrate 82. Representative examples of ink barrier materials 280 which may be employed for this purpose are listed above. The anchor members 252 (and, in particular, their isotropically-etched, concave character) physically engage the layer of ink barrier material 280 and prevent it from being sheared, detached, or otherwise disengaged from the substrate 82.

In one embodiment, a high-durability printhead is provided in which the anchor members and thin-film circuitry on the substrate are produced in a unitary process that enables the fabrication of both elements in a substantially simultaneous manner.

As a preliminary point of information, an embodiment of the present invention shall not be restricted to any particular types, sizes, or arrangements of internal printhead components.

For the sake of clarity, the materials and processes involve a thermal inkjet printhead with the understanding that this system is being described for example purposes only in a non-limiting manner.

It should also be understood that the present invention and its various embodiments shall not be restricted to any particular compositions, materials, proportions, amounts, and other parameters unless otherwise stated herein. All numerical values and ranges presented below are provided for example purposes only and represent preferred embodiments designed to achieve maximum operational efficiency. Likewise, the various embodiments of this invention shall not be limited to any particular construction techniques (including any specific etching procedures) unless otherwise stated herein. For example, the term "etching" as used throughout this discussion shall broadly encompass any type of process in which materials are selectively removed from the designated printhead component(s), with this term including any applicable chemical, mechanical, or electrical techniques.

In one embodiment, the process of the present invention involves forming at least one isotropically-etched upwardly-extending metallic anchor member on a portion of the substrate which surrounds the ink ejector(s). The purpose of the anchor member is to effectively "interlock" with the layer of ink barrier material positioned on the substrate so that the barrier layer is securely engaged in position without the use of additional adhesive materials, elaborate cleaning procedures, and the like.

Anchor members produced in accordance with the isotropic etching process will include an inwardly-etched concave side wall in order to form a substantially curved "hourglass" configuration. In accordance with this particular design, the resulting anchor member will include a circumferential outwardly-projecting region (explained below) adjacent the upper face of the anchor member. This region enables the layer of ink barrier material to be securely engaged in position against the substrate and circuitry thereon. Specifically, the outwardly-projecting region described herein physically engages the layer of barrier material and thereby prevents premature delamination of this structure.

Next, the upper layer is selectively etched in order to remove a plurality of portions or sections of the upper layer. The number of portions which are removed at this stage may be varied to produce the desired circuit architecture in the final printhead structure. This etching stage will likewise leave a plurality of other portions of the upper layer intact and unaffected. Thus, as a result of this step, multiple portions of the upper layer will remain in place which are nonetheless spaced apart from each other. Likewise, etching of the upper layer will also expose multiple regions or sections of the lower layer, with these exposed regions being located between the remaining portions of the upper layer as shown in the accompanying drawing figures and discussed in detail below.

After the first etching step is completed, the multiple regions of the lower layer that were exposed after etching of the upper layer are isotropically-etched.

As a result of the foregoing process, the exposed multiple regions of the lower layer are etched away and removed in order to expose the substrate thereunder. Likewise, this step will generate a plurality of "upwardly-extending structures" positioned on the substrate and spaced apart from each other. Each of the upwardly-extending structures will include (A) an isotropically-etched section of the lower layer which, in a preferred embodiment, will comprise an inwardly-extending concave side wall in order to form a substantially curved "hourglass" configuration as previously noted; and (B) a section of the upper layer thereon. Some of these upwardly-extending structures will become elongate conductive circuit elements (or "bus members") in the printhead, with some of them being converted into the anchor members which are used to retain the ink barrier layer in position.

Next, at least one of the upwardly-extending structures on the substrate is etched as broadly defined above to remove the remaining section of the upper layer therefrom. Removal of the upper layer will leave the underlying isotropically-etched section of the lower layer intact. This section of the lower layer will constitute one of the anchor members discussed above which, at this stage, is completed and ready for use. As previously noted, the isotropically-etched character of the anchor members enables the layer of ink barrier material to be securely engaged in position over the substrate and circuit elements thereon. The upwardly-extending structures that were not etched in accordance with the previous step will remain intact and, in particular, will again function as the elongate conductive circuit elements (bus members) in the completed printhead. These circuit elements electrically communicate with the ink ejectors in the printhead. Likewise, the circuit elements also communicate with the operating components of the printer unit which provide the electrical signals that are used to initiate ink delivery. From a structural standpoint, each of the circuit elements in the present embodiment includes (A) the upper layer made from the second metal which comprises the primary conductive pathway for electrical signals in the printhead; and (B) an intermediate portion of material positioned between the upper layer and the substrate which has the lower layer made from the first metal discussed above. It is therefore desired to emphasize that the lower layer of metal in the present embodiment is employed in both the anchor members and circuit elements. This common use of structural materials enables both the anchor members and circuit elements to be fabricated in a substantially simultaneous manner, thereby increasing the overall efficiency and economy of the production system.

In order to complete the printhead production sequence discussed above, a layer of at least one ink barrier material is applied to the substrate and components thereon which surround the ink ejectors. The ink barrier material is designed to entirely cover the elongate conductive circuit elements for insulation and protective purposes. Specifically, when applied in accordance with an embodiment of the present invention, the ink barrier material will completely cover the elongate conductive circuit elements, the anchor members, and any exposed portions of the substrate therebetween in a preferred embodiment.

It should also be noted that the anchor members discussed herein may be employed in any number, size, or shape as appropriate in accordance with routine preliminary studies on the particular printhead of interest. Likewise, the overall size/shape of the anchor members may be varied, with the thickness thereof being substantially equivalent to the values provided above in connection with the lower layer of the first metal from which the anchor members are fabricated. Regarding the elongate conductive circuit elements discussed above (which are optimally dispersed around and between the anchor members in a selected pattern), each circuit element is effectively secured to the underlying substrate using an intermediate portion of material positioned therebetween which has the lower layer of the first metal. It is therefore desired to recognize that both the elongate conductive circuit elements and the anchor members are again produced in a substantially simultaneous manner using the procedures discussed herein which provide a considerable improvement in manufacturing efficiency.

Finally, any references to components in the singular shall likewise encompass the use of such components in multiple quantities unless otherwise indicated above. The present invention shall therefore only be construed in accordance with the following claims:

The invention that is claimed is:

1. A method for securely anchoring a barrier layer to a substrate in a printhead comprising:

forming at least one extending metallic anchor member supported by a substrate having a fluid ejector thereon; and covering said anchor member with a layer of at least one fluid barrier material, said anchor member securely attaching said layer of fluid barrier material to said substrate.

2. The method of claim 1 wherein said anchor member is comprised of a metal selected from the group consisting of tantalum, aluminum, rhodium, chromium, titanium, molybdenum, and mixtures thereof.

3. The method of claim 1 wherein said anchor member has a thickness of about 0.3–1.0 $\mu$m.

4. A method for securely anchoring a barrier layer to a substrate in a printhead comprising:

applying at least one layer comprised of metal to a substrate having a fluid ejector;

forming, with said layer, at least one extending metallic anchor member; and covering said anchor member with a layer of at least one fluid barrier material, said anchor member securely attaching said ink barrier material to said substrate.

5. A method of forming a fluid ejection device comprising:

disposing a mechanical intercoupling structure on a substrate at least one fluid ejector thereon;

disposing a chamber layer over said substrate, wherein side walls of an ejection chamber are defined with the chamber layer;

substantially embedding said mechanical intercoupling structure with the chamber layer; and encapsulating the mechanical intercoupling structure with the substrate and the chamber layer.

6. The method of claim 5, wherein said mechanical intercoupling structure secures said chamber layer to said substrate.

7. The method of claim 5, wherein said mechanical intercoupling structure is comprised of a metal.

8. The method of claim 7, wherein said mechanical intercoupling structure includes at least one of the metals tantalum, aluminum, rhodium, chromium, titanium, molybdenum, tungsten, platinum, and palladium.

9. The method of claim 5, wherein said chamber layer covers a conductive trace, wherein said chamber layer is a fluid barrier that substantially hinders interaction of a fluid with said conductive trace.

10. The method of claim 5, wherein said chamber layer comprises an electrically insulative material.

11. The method of claim 5, wherein said chamber layer comprises a polymer.

12. The method of claim 5, wherein said mechanical intercoupling structure is substantially hour-glass shaped in that the structure has top and bottom surfaces, and a narrowed portion therebetween.

13. The method of claim 5, wherein said mechanical intercoupling structure includes a concave side wall.

14. The method of claim 5, wherein said concave side wall is curved.

15. The method of claim 5, wherein said mechanical intercoupling structure includes: a top surface defining a top surface width; a bottom surface; and a central portion between the top surface and the bottom surface defining a width that is less than the top surface width.

16. A method of coupling a barrier layer to a substrate of a fluid ejection device comprising:

positioning at least one metallic anchor member on a substrate;

positioning a layer of barrier material over the substrate and the at least one metallic anchor member;

substantially embedding said at least one metallic anchor member with the layer of barrier material; and encapsulating the at least one metallic anchor member with the substrate and the barrier layer.

17. The method of claim 16, wherein said metallic anchor member secures said layer of barrier material to said substrate.

18. The method of claim 16, wherein said metallic anchor member further includes:

a first metal layer disposed an a portion of said substrate; and a second metal layer disposed on at least a portion of said first metal layer, and wherein said second metal layer is different from said first metal layer.

19. The method of claim 18, wherein said metallic anchor member is substantially hour-glass shaped in that the structure has top and bottom surfaces, and a narrowed portion therebetween.

20. The method of claim 16, wherein said metallic anchor member includes a concave side wall.

21. The method of claim 20, wherein said concave side wall is curved.

22. The method of claim wherein said metallic anchor member includes:

a top surface defining a top surface width;

a bottom surface; and a central portion between the top surface and the bottom surface defining a width that is less than the top surface width.

23. A method of forming a fluid ejection cartridge comprising:

fluidically coupling a fluid reservoir with a fluid ejection device, wherein the fluid ejection device has a substrate having at least one fluid ejector thereon, a mechanical intercoupling structure disposed on said substrate, and a firing chamber layer disposed on said substrate and defining side walls of a firing chamber; and substantially embedding said mechanical intercoupling structure into the firing chamber layer; and encapsulating the mechanical intercoupling structure with the substrate and the firing chamber layer.

24. The method of claim 23, wherein said mechanical intercoupling structure secures said firing chamber layer to said substrate.

25. The method of claim 23, wherein said mechanical intercoupling structure is comprised of a metal.

26. The method of claim 23, wherein said mechanical intercoupling structure includes: a first metal layer disposed on a portion of said substrate; and a second metal layer disposed on at least a portion of said first metal layer, and wherein said second metal layer is different from said first metal layer.

27. The method of claim 23, wherein said mechanical intercoupling structure is substantially hour-glass shaped in that the structure has top and bottom surfaces, and a narrowed portion therebetween.

28. The method of claim 27, wherein said mechanical intercoupling structure includes a concave side wall.

29. The method of claim 28, wherein said concave side wall is curved.

30. A method of coupling a barrier layer to a substrate of a fluid ejection device comprising:

forming a fluid ejector on a first area of said substrate;

disposing the barrier layer over a second area that surrounds the first area, wherein the barrier layer surrounds said fluid ejector;

coupling said barrier layer to said substrate in the second area with an anchor means; and encapsulating the anchor means with the substrate and the barrier layer.

31. The method of claim 30, wherein said anchor means includes an anchor member extending from said substrate and encompassed by said barrier layer, wherein said anchor member has a concave and curved side wall.

* * * * *

UNITED STATES PATENT AND TRADEMARK OFFICE

CERTIFICATE OF CORRECTION

PATENT NO. : 6,787,049 B2
DATED : September 7, 2004
INVENTOR(S) : Tom et al.

It is certified that error appears in the above-identified patent and that said Letters Patent is hereby corrected as shown below:

Column 30,
Line 3, delete “an” and insert in lieu therefor -- on --;
Line 16, after “claim” insert -- 16 --.

Signed and Sealed this

Twenty-first Day of December, 2004

JON W. DUDAS
*Director of the United States Patent and Trademark Office*